US007252723B2

(12) United States Patent
Dif et al.

(10) Patent No.: US 7,252,723 B2
(45) Date of Patent: Aug. 7, 2007

(54) ALCUMG ALLOYS WITH HIGH DAMAGE TOLERANCE SUITABLE FOR USE AS STRUCTURAL MEMBERS IN AIRCRAFTS

(75) Inventors: Ronan Dif, Saint Etienne de Saint Geoirs (FR); Timothy Warner, Voreppe (FR); Bernard Bes, Seyssins (FR)

(73) Assignee: Pechiney Rhenalu, Paris (FR)

( * ) Notice: Subject to any disclaimer, the term of this patent is extended or adjusted under 35 U.S.C. 154(b) by 251 days.

(21) Appl. No.: 10/614,888

(22) Filed: Jul. 9, 2003

(65) Prior Publication Data

US 2004/0079455 A1 Apr. 29, 2004

Related U.S. Application Data

(60) Provisional application No. 60/394,234, filed on Jul. 9, 2002.

(51) Int. Cl.
*C22C 21/12* (2006.01)
*C22F 1/057* (2006.01)

(52) U.S. Cl. ..... 148/417; 148/693; 148/700; 420/533; 420/552

(58) Field of Classification Search ..... 148/693, 148/700, 417; 420/533, 552
See application file for complete search history.

(56) References Cited

U.S. PATENT DOCUMENTS

| | | | | |
|---|---|---|---|---|
| 5,213,639 | A | 5/1993 | Colvin et al. | |
| 5,593,516 | A * | 1/1997 | Cassada, III | 148/418 |
| 6,444,058 | B1 | 9/2002 | Liu et al. | |
| 6,562,154 | B1 * | 5/2003 | Rioja et al. | 148/415 |
| 2004/0099353 | A1 * | 5/2004 | Benedictus et al. | 148/552 |
| 2004/0112480 | A1 * | 6/2004 | Benedictus et al. | 148/551 |

FOREIGN PATENT DOCUMENTS

| | | |
|---|---|---|
| EP | 1 170 394 A2 | 1/2002 |
| FR | 2717827 | 9/1995 |
| WO | WO 99/31287 | 6/1999 |

* cited by examiner

*Primary Examiner*—Roy King
*Assistant Examiner*—Janelle Morillo
(74) *Attorney, Agent, or Firm*—Womble Carlyle Sandridge & Rice, PLLC

(57) ABSTRACT

New alloys for potential use in applications such as in lower wing skins and fuselage skins are disclosed. Specifically, Mn-free 2×24 alloys potentially suitable for thick plate and thin plate and sheet applications are believed to be novel and to provide unexpectedly superior properties.

64 Claims, 16 Drawing Sheets

ALCUMG ALLOYS WITH HIGH DAMAGE TOLERANCE SUITABLE FOR USE AS STRUCTURAL MEMBERS IN AIRCRAFTS

CROSS REFERENCE TO RELATED APPLICATIONS

This application claims priority from Provisional Application Ser. No. 60/394,234, filed Jul. 9, 2002, the content of which is incorporated herein by reference in its entirety.

BACKGROUND OF THE INVENTION

1. Field of the Invention

The present invention relates generally to damage tolerant aluminum alloys, and in particular, to such alloys useful in the aerospace industry suitable for use in lower wing skin applications and as fuselage skin.

2. Description of Related Art

Materials particularly adapted for use in lower wing skin applications including 2×24 alloys are generally known, as described, for example, in U.S. Pat. Nos. 5,213,639 and 6,444,058 as well as in the PCT application WO 99/31287, the content of which is incorporated herein by reference in their entireties. Damage tolerance of 2×24 alloys is of particular importance and materials that have excellent properties in this regard are highly desirable. These 2×24 alloys, derived from the chemical composition of the 2024 alloy, usually contain manganese in a concentration of at least 0.15 to 0.20%, and up to 0.8 or 0.9%. This is the case of the 2×24 alloys which have been standardized by The Aluminum Association (AA): 2024, 2024A, 2124, 2224, 2224A, 2324, 2424, 2524.

European Patent Application EP 1 170 394 A discloses methods for manufacturing damage tolerant AlCuMg sheet. These methods involve unusual (hot cross rolling) or otherwise expensive manufacturing steps (repeated intermediate heat treatment) in order to obtain a precisely controlled microstructure.

SUMMARY OF THE INVENTION

According to the present invention, there is provided a substantially manganese-free aluminum alloy rolled product consisting essentially of (in percent by weight):

| | | | |
|---|---|---|---|
| Cu 3.6–4.5%, | Mg 1.0–1.6%, | Zr 0.08–0.20%, | Sc up to 0.06%, |
| Fe up to 0.08%, | Si up to 0.09% | Mn less than 0.05%, | |
| the remainder aluminum and incident impurities. | | | |

This product, as plate or sheet, presents a good compromise between fracture toughness and mechanical strength. It can be provided as plate or sheet, and is suitable for use in applications that require high damage tolerance, such as in lower wing skins or fuselage skin.

As used herein, the term "sheet" includes flat rolled aluminum products having a thickness form about 0.2 mm to about 12 mm, whereas the term "plate" is limited to products thicker than 12 mm. This definition is different from the one used in European Standard EN 12258-1.

Specifically, substantially Mn-free AlCuMg alloys for applications such as in lower wing skins are believed to be novel and to provide unexpectedly superior properties. As used herein, "substantially Mn-free" means up to 0.05% Mn. These alloys were compared against high damage tolerant material 2024 (Reference DT) according to prior art.

According to embodiments of the present invention, manganese has been totally replaced by zirconium or by zirconium+300 μg/g of scandium.

Sheet or plate according to the present invention may have one or more of the following combinations of properties:

(a) a tensile yield strength in the longitudinal direction ($TYS_{(L)}$) of more than 400 MPa, preferably more than 430 MPa and even more preferably more than 450 MPa, and an apparent fracture toughness $K_{app(T-L)}$ of more than 110 $MPa\sqrt{m}$, and preferably more than 115 $MPa\sqrt{m}$, measured according to ASTM E 561 in the T-L orientation on a specimen with a width of W=127 mm;

(b) an ultimate tensile strength in the longitudinal direction ($UTS_{(L)}$) of more than 450 MPa, and preferably more than 460 MPa, and an elongation at fracture in the longitudinal direction of more than 24%, and preferably more than 26%;

(c) a tensile yield strength in the longitudinal direction ($TYS_{(L)}$) of more than 400 MPa, preferably more than 430 MPa and even more preferably more than 450 MPa, and a Kahn stress $R_e$ of at least 180 MPa, and preferably at least 190 MPa.

Plate according to the present invention may have one or more of the following combinations of properties:

(a) a $UTS_{(L)}$ of more than 500 MPa, preferably more than 520 MPa, and even more preferably more than 530 MPa, and a $K_{app(L-T)}$ of more than 75 $MPa\sqrt{m}$, and preferably more than 77 $MPa\sqrt{m}$, measured according to ASTM E 561 on a 6.35 mm thick C(T) specimen with a width of W=40 mm;

(b) a tensile yield strength in the longitudinal direction ($TYS_{(L)}$) of more than 450 MPa, and preferably more than 460 MPa, and a $K_{app(L-T)}$ of more than 77 $MPa\sqrt{m}$, measured according to ASTM E 561 on a 6.35 mm thick C(T) specimen with a width of W=40 mm;

(c) a tensile yield strength in the longitudinal direction ($TYS_{(L)}$) of more than 350 MPa, preferably more than 400 MPa and even more preferably more than 450 MPa, and a Kahn stress $R_e$ of at least 190 MPa.

Another object of the present invention involves providing methods for manufacturing sheet products and plate products in said substantially manganese-free alloys. These methods are particularly simple, especially for production of sheet.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF A PREFERRED EMBODIMENT

Figure 1A:
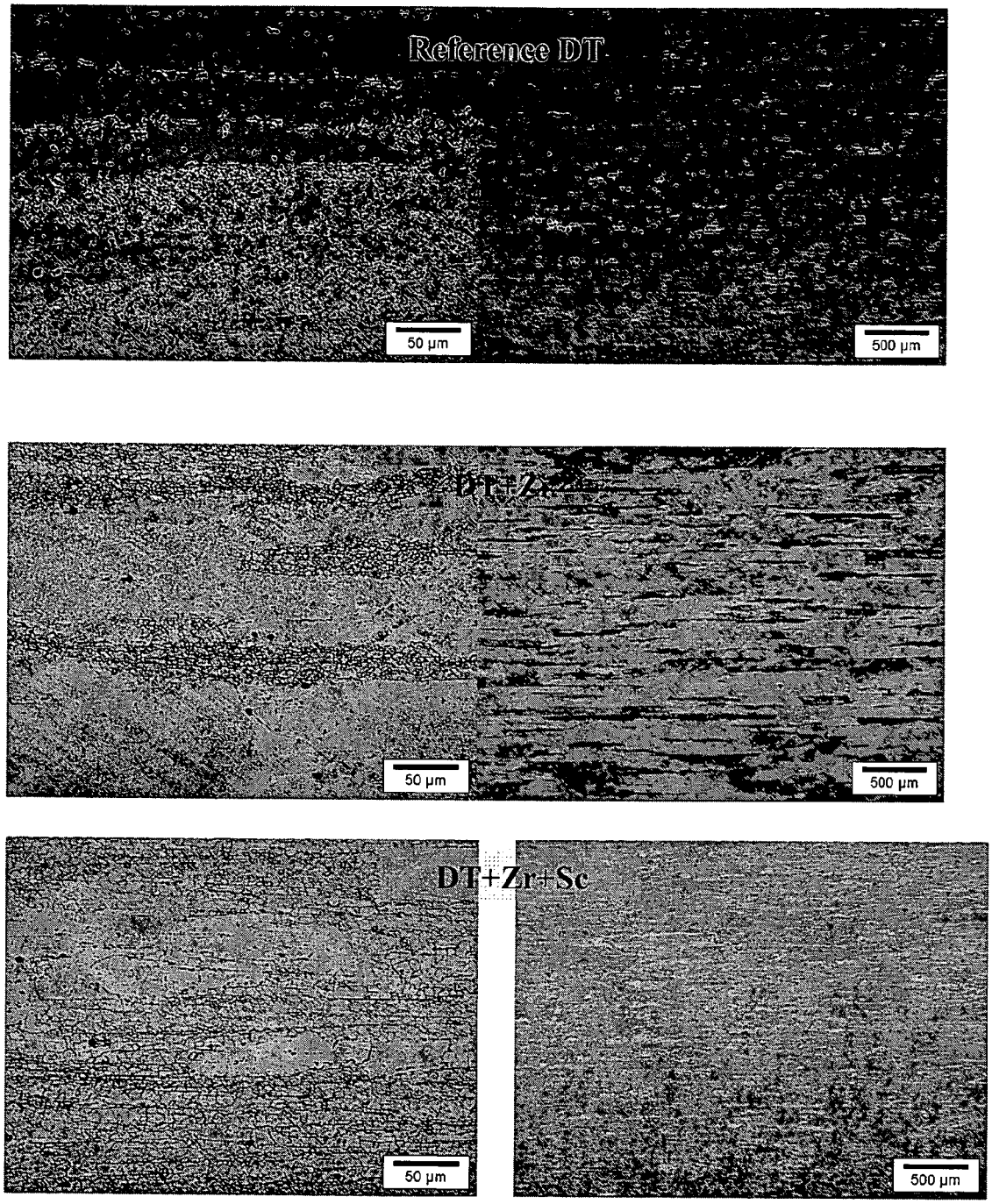
FIG. 1 shows optical micrographs according to the present invention: after chromic etch (FIG. 1*a*) and after anodic oxidation (FIG. 1*b*). The grain structure can be seen.

In accordance with the present invention, an attempt has been made to improve the damage tolerance of 2×24 alloys suitable for lower wing skin applications (in the form of plate of thickness typically of the order of 12 to 25 mm) and fuselage skin applications (in the form of sheet of thickness typically of the order of 3 to 9 mm). Some applications of 2×24 alloys include, for example, lower wing skin structural members and wing spar members.

Several alloys were tested:

2×24 without Manganese and with 0.1% Zirconium

2×24 without Manganese and with 0.1% Zirconium plus 300 μg/g of Scandium

2×24 with 0.25% Manganese and with 0.1% Zirconium plus 300 μg/g of Scandium

2×24 with 0.50% Manganese and with 0.1% Zirconium plus 300 μg/g of Scandium

A high damage tolerant 2024 with no addition of Scandium and Zirconium (internal designation DT, composition in agreement with AA2024A) is taken as the reference material.

Specifically, Mn-free 2×24 alloys for applications such as in lower wing skins are found to provide unexpectedly superior properties. As used herein, "Mn-free" means up to 0.05% Mn. Although a loss of strength is expected in some cases in the T351 temper, better damage tolerance can be achieved, owing to a lower volume fraction of AlFeMn-type coarse intermetallics.

In a preferred embodiment, the Scandium content was chosen at a level of 300 ppm in order to substantially avoid the precipitation of coarse (Al,Cu,Sc) primary phases while keeping a strong anti-recrystallization influence. However, different amounts of scandium might be possible as well without departing from the scope of the present invention.

According to preferred embodiments of the present invention, there is provided an Al alloy sheet or plate product comprising: 3.6-4.5% Cu, 1.0-1.6% Mg, 0.08-0.20% Zr (preferred 0.08-0.14% Zr), 0.0-0.06% Sc (preferred 0.02-0.05% Sc).

Al alloy sheet or plate products of the present invention preferably have a recrystallized volume fraction of 5% maximum according to some embodiments. In particularly advantageous embodiments there is provided an aluminum alloy sheet or plate product comprising 3.7-4.2% Cu (preferred 3.8-4.2%), 1.1-1.5% Mg (preferred 1.2-1.5%), 0.10-0.14% Zr, and 0-0.05% Sc (preferred 0.02-0.05% Sc). In one embodiment, there is provided an aluminum alloy sheet or plate product that is substantially Mn-free, which means here having less than 0.05% Mn. In further embodiments, said sheet or plate product contains up to 0.01% Mn. Scandium, if included, is preferably included in an amount from 0.02-0.05%; a Scandium content of 300 ppm (0.03%) by mass has been used in a preferred embodiment.

The products according to the present invention can be subjected to naturally aged tempers with various degrees of post-quench cold-working (T351, T37, T39 . . . ) and artificially aged tempers with various degrees of post-quench cold-working (T851, T87, T89 . . . ).

A preferred method for obtaining plate products according to the present invention comprises:

(a) Casting of a rolling ingot, followed by optional stress relieving, and scalping, (b) Homogenization at a temperature between 450 and 510° C., (c) Hot-rolling on a reversing mill, preferably with an exit temperature between 350 and 390° C., (d) Optionally, for plate with a thickness of less than about 30 mm, one intermediate reheating to about 480° C., followed by one or more hot-rolling passes, the final exit temperature preferably being comprised between 350 and 370° C., (e) Solution heat treatment at a temperature between 490 and 510° C., followed by a water quench and natural aging, (f) Cold working by stretching alone or cold rolling followed by stretching, optionally followed by artificial aging.

A preferred method for obtaining sheet products according to the present invention comprises:

(a) Casting of a rolling ingot, followed by optional stress relieving, and scalping, (b) Homogenization at a temperature between 450 and 510° C., (c) Hot-rolling down to a thickness of less than 12 mm, and in any case not more than 200%, and preferably not more than 150% of final thickness, with a final exit temperature between 230 and 350° C., preferably between 230 and 300° C., and more preferably between 230 and 255° C., (d) Optionally cold rolling, (e) Solution heat treatment at a temperature between 490 and 510° C., followed by a water quench, (f) Cold working by stretching alone or cold rolling followed by stretching, optionally followed by artificial aging.

This preferred method for obtaining sheet is very simple and does not involve reheating between hot-rolling steps, or recrystallization treatment.

The product according to the present invention is particularly suitable for use as a lower wing skin structural member. Another advantageous use is the use as fuselage skin sheet. Both sheet and plate can be clad.

A preferred sheet or thin plate with a thickness below about 12 mm in T351 temper has a da/dn in T-L direction which fulfills at least one, and preferably two or more, and even more preferably all of the following conditions:

da/dn less than 1.3 $10^{-4}$ mm/cycles at $\Delta K=10$ MPa$\sqrt{m}$, da/dn less than 4.0 $10^{-4}$ mm/cycles at $\Delta K=15$ MPa$\sqrt{m}$, da/dn less than 8.0 $10^{-4}$ mm/cycles at $\Delta K=20$ MPa$\sqrt{m}$, da/dn less than 16 $10^{-4}$ mm/cycles at $\Delta K=25$ MPa$\sqrt{m}$, da/dn less than 25 $10^{-4}$ mm/cycles at $\Delta K=30$ MPa$\sqrt{m}$.

A preferred plate in T351 temper has a da/dn in T-L direction which fulfills at least one, and preferably two or more, and even more preferably all of the following conditions:

da/dn less than 3.0 $10^{-5}$ mm/cycles at $\Delta K=10$ MPa$\sqrt{m}$, da/dn less than 1.0 $10^{-4}$ mm/cycles at $\Delta K=15$ MPa$\sqrt{m}$, da/dn less than 1.0 $10^{-3}$ mm/cycles at $\Delta K=25$ MPa$\sqrt{m}$, da/dn less than 3 $10^{-3}$ mm/cycles at $\Delta K=30$ MPa$\sqrt{m}$.

Products according to the present invention exhibit in a corrosion test according to ASTM G 110 a maximum intergranular corrosion attack of less than 80 μm in T39 temper, and/or less than 200 μm in T851 temper, and/or less than 250 μm in T89 temper, and/or less than 300 μm in T351 temper. In a preferred embodiment, they have a maximum intergranular attack of less than 70 μm in T39 temper, and/or less than 180 μm in T851 temper, and/or less than 220 μm in T89 temper, and/or less than 270 μm in T351 temper.

It should be noted that according to some embodiments of the present invention, scandium, although preferred, can optionally be replaced by one or more of the following chemical elements: Hf, La, Ti, Ce, Nd, Eu, Gd, Tb, Dy, Ho, Er, Y, Yb, Cr. Typically, the concentration of each of these elements should not exceed about 0.1%, and the total of said elements should not exceed about 0.3%.

EXAMPLES

Example 1

Manufacturing and Microstructural Characterization a) Manufacturing of Alloys/Tempers Casting of several ingots was conducted at a laboratory scale cast house, on (320 mm×120 mm) slabs (2t casting unit). The compositions in weight % are given in Table 1.

TABLE 1

Composition of the alloys (in weight %)

| Alloy | Si | Fe | Cu | Mn | Mg | Ti | Zr | Sc |
|---|---|---|---|---|---|---|---|---|
| DT | <0.06 | 0.06 | 4.12 | 0.40 | 1.37 | 0.022 | | |
| DT + Zr | <0.06 | 0.06 | 3.81 | 0.008 | 1.41 | 0.022 | 0.109 | |
| DT + Zr + Sc | <0.06 | 0.07 | 3.81 | 0.008 | 1.36 | 0.024 | 0.107 | 0.028 |
| 24LoMn | <0.06 | 0.05 | 4.20 | 0.24 | 1.23 | 0.016 | 0.11 | 0.032 |
| 24HiMn | <0.06 | 0.06 | 4.14 | 0.51 | 1.24 | 0.019 | 0.11 | 0.032 |

Table 1 also gives the alloy designations that will be used hereinbelow:

DT stands for reference high damage tolerance 2024 (AA2024A)

DT+Zr and DT+Zr+Sc respectively designate DT with manganese totally replaced by zirconium and zirconium+scandium.

24LoMn and 24HiMn stand for DT (AA2024A) based compositions with Zr+Sc and various (respectively 0.25% and 0.50%) Mn levels.

The detailed conditions of the transformation of the slabs are provided below:

Homogenization on the slabs scalped down to 100 mm thick.

Reheating at 480+/−10° C. for at least 30 minutes.

Rolling on the hot reversing mill, down to a thickness of 20 mm (intermediate re-heating to 480° C. at about 27 mm, before the two last passes), aiming at an exit temperature of 370+/−20° C.

Solution heat treatment of 600 mm (L)×60 mm (LT)×20 mm (ST) specimens, in an air furnace.

Water quench and 24 h natural aging.

Cold-Working by stretching or cold-rolling+stretching in order to obtain T3X tempers that will be characterized, or aged to T8X tempers (see Table 2).

The details regarding the actual manufacturing parameters are given in Table 2.

TABLE 2

Manufacturing conditions

| Alloy | Homogenization | Hot-Rolling Lay-on Temperature (° C.) | Hot-Rolling Exit Temperature (° C.) | Solution Heat Treatment | Cold-Working (%) (Bold characters refer to cold-rolling) |
|---|---|---|---|---|---|
| DT | 12 h at 500° C. (heat-up of 12 h) | 480 +/− 50° C. | 370 +/− 20° C. | 6 h at 500° C. (heat-up for 2 h) | T351: **0** + 2<br>T39: 1 + **9.6** + 1<br>T3x: 1 + **12.3** + 1<br>T851: **0** + 2<br>T89: 1 + **9.8** + 1 |
| DT + Zr | | 480 +/− 50° C. | 370 +/− 20° C. | | T351: **0** + 2<br>T39: 1 + **8.3** + 1<br>T3x: 1 + **12.6** + 1<br>T851: **0** + 2<br>T89: 1 + **9.8** + 1 |
| DT + Zr + Sc | | 480 +/− 50° C. | 370 +/− 20 ° C. | | T351: **0** + 2<br>T39: 1 + **9.8** + 1<br>T3x: 1 + **12.8** + 1<br>T851: **0** + 2<br>T89: 1 + **9.6** + 1 |
| 24LoMn | | 431° C. | 379° C. | | T351: **0** + 1.7<br>T39: **7.2** + 0.3<br>T3x: **12.6** + 0.5<br>T851: **0** + 2<br>T89: **8.2** + 0.1 |

TABLE 2-continued

| Alloy | Homogenization | Hot-Rolling Lay-on Temperature (° C.) | Hot-Rolling Exit Temperature (° C.) | Solution Heat Treatment | Cold-Working (%) (Bold characters refer to cold-rolling) |
|---|---|---|---|---|---|
| | | Manufacturing conditions | | | |
| 24HiMn | | 442° C. | 386° C. | | T351: **0** + 2.5<br>T39: **7.3** + 0.7<br>T3x: **11.8** + 0.3 |

b) Microstructural Characterization

The microstructural characterization program of these alloys was only conducted in the basic T351 temper. It consisted of Differential Scanning Calorimetry (DSC) and Optical micrography.

Figure 1B:
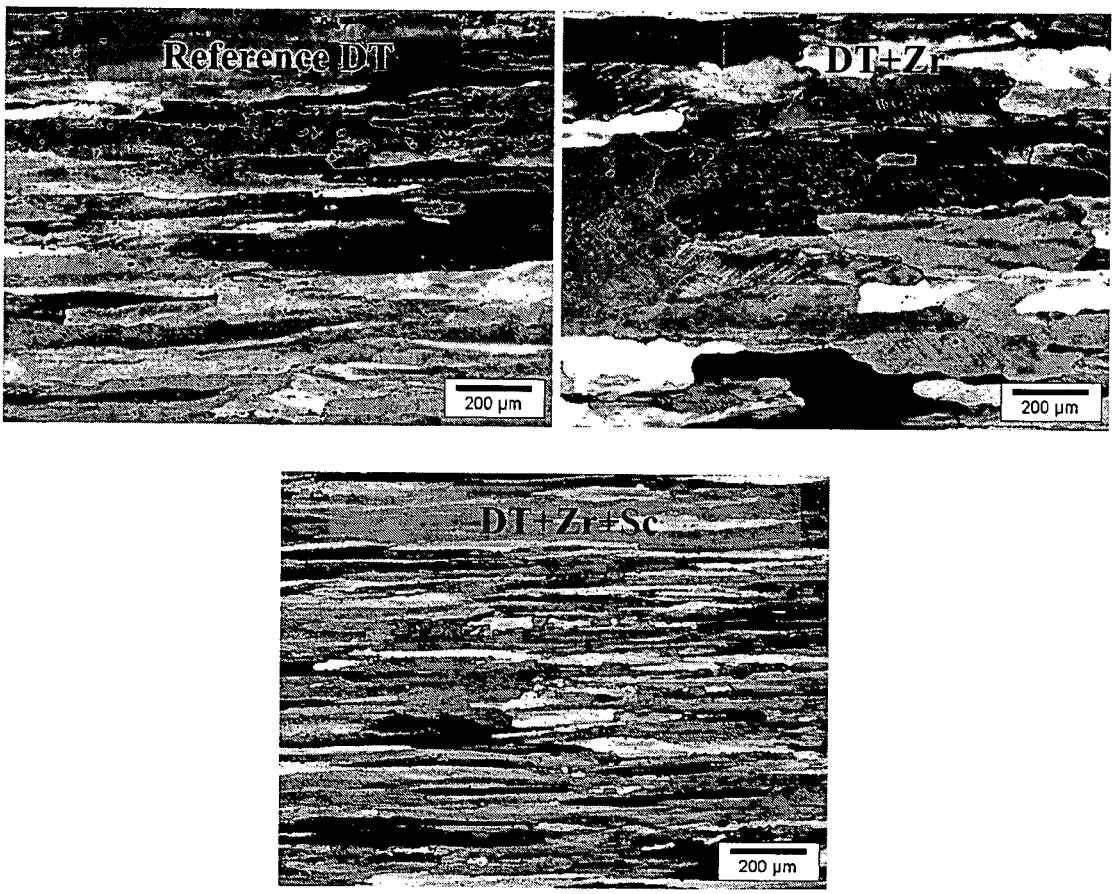

Table 3 below gives the main microstructural characteristics of the alloys in the T351 temper. According to the DSC results, all these alloys seem to be well solutionized. Detailed micrographs of some of the alloys are provided in FIG. 1.

Plane stress fracture toughness at half-thickness by $K_{app}$ determination on 6.35 mm (0.25") thick specimens with W=40 mm (1.6") in the L-T orientation (according to ASTM E561).

Fatigue crack growth rate (FCGR) at half-thickness on 6.35 mm (0.25") thick "CT" specimens with W=40 mm (1.6") in the L-T and T-L orientation (according to ASTM E647).

Figure 2:
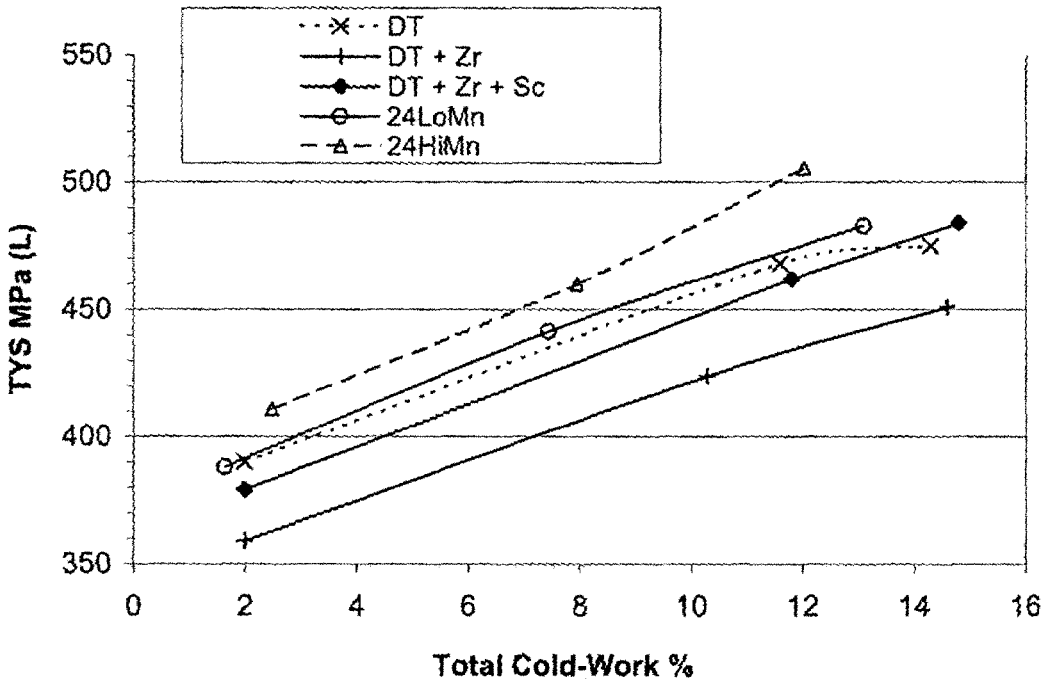
FIG. 2 shows the tensile yield strength (TYS) as a function of cold-work for the different alloys in T3X tempers.
Figure 3:
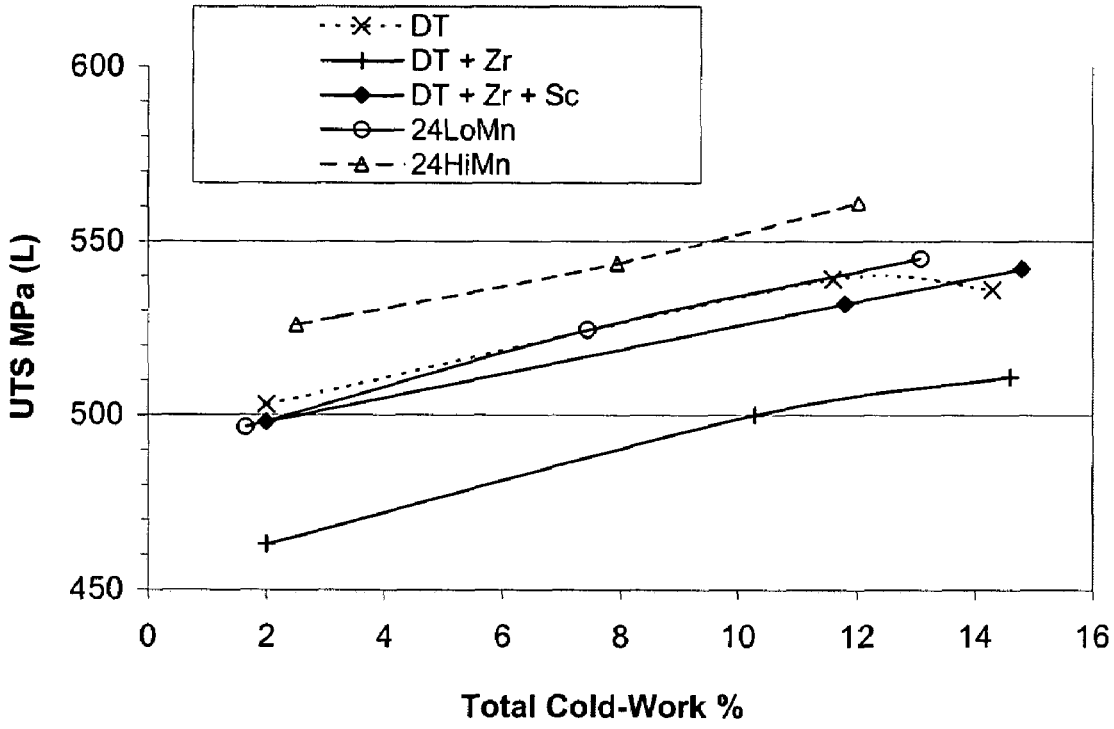
FIG. 3 shows the ultimate tensile strength (UTS) as a function of cold-work for the different alloys in T3X tempers.

The static tensile properties in the T3X tempers are summarized in Table 4 and FIGS. 2 and 3.

TABLE 3

DSC results (before and after solution heat treating, sampled at half-thickness) and grain structure of the plates (chromic etch and anodic oxidation)

| Alloy | DSC - As-Rolled Temperature (° C.) | DSC - As-Rolled Peak Area (J/g) | DSC-T351 Temperature (° C.) | DSC-T351 Peak Area (J/g) | Microstructure - T351 ReX rate (%) | Microstructure - T351 Grain structure |
|---|---|---|---|---|---|---|
| DT | — | — | No Peak | 0 | >95% | Coarse and elongated |
| DT + Zr | — | — | No Peak | 0 | ~85% | Coarse and not very elongated; well-defined sub-grains |
| DT + Zr + Sc | — | — | No Peak | 0 | <5% | Very thin and elongated; well-defined sub-grains |
| 24LoMn | 507.4 | 1.26 | No Peak | 0 | <5% | Very thin and elongated; well-defined sub-grains |
| 24HiMn | 508.7 | 0.56 | No Peak | 0 | <5% | Very thin and elongated; well-defined sub-grains |

Example 2

Mechanical and Corrosion Evaluation in T3X Tempers

The alloys manufactured in Example 1 in the various T3X tempers were characterized as follows:

Static Tensile Testing at half-thickness in the L and LT directions

Exfoliation corrosion resistance

Damage tolerance:

The following effects are demonstrated:

A Zr+Sc addition totally compensates for manganese (compare DT and DT+Zr+Sc).

Manganese is clearly beneficial for UTS and TYS tensile properties (compare DT+Zr+Sc", "24LoMn", "24HiMn".

The evolution of tensile properties with post-quench cold-work is similar for all the 2xxx variants studied.

As for elongation, manganese seems to be the most important compositional parameter (detrimental influence).

TABLE 4

Static properties in various T3X tempers

| Alloy | Process | Temper | Cold Work [%] | L orientation UTS [MPa] | L orientation TYS [MPa] | L orientation A [%] | LT orientation UTS [MPa] | LT orientation TYS [MPa] | LT orientation A [%] |
|---|---|---|---|---|---|---|---|---|---|
| DT | 2% | T351 | 2.0 | 503 | 390 | 19.6 | 488 | 349 | 20.4 |
| | 1% + 10% + 1% | T39 | 11.6 | 539 | 468 | 11.7 | 518 | 421 | 13.6 |
| | 1% + 13% + 1% | T3x | 14.3 | 536 | 475 | 9.3 | | | |

TABLE 4-continued

Static properties in various T3X tempers

| Alloy | Process | Temper | Cold Work [%] | L orientation UTS [MPa] | L orientation TYS [MPa] | L orientation A [%] | LT orientation UTS [MPa] | LT orientation TYS [MPa] | LT orientation A [%] |
|---|---|---|---|---|---|---|---|---|---|
| DT + Zr | 2% | T351 | 2.0 | 463 | 359 | 23.0 | 453 | 325 | 23.9 |
| | 1% + 10% + 1% | T39 | 10.3 | 500 | 424 | 15.4 | 481 | 392 | 15.5 |
| | 1% + 13% + 1% | T3x | 14.6 | 511 | 451 | 13.4 | | | |
| DT + Zr + Sc | 2% | T351 | 2.0 | 498 | 379 | 20.0 | 465 | 335 | 24.1 |
| | 1% + 10% + 1% | T39 | 11.8 | 532 | 462 | 12.9 | 495 | 409 | 17.2 |
| | 1% + 13% + 1% | T3x | 14.8 | 542 | 484 | 10.5 | | | |
| 24LoMn | 2.5% | T351 | 1.7 | 497 | 388 | 21.1 | 471 | 350 | 22.9 |
| | 8% + 2.5% | T39 | 7.5 | 525 | 442 | 15.6 | 495 | 397 | 18.5 |
| | 12% + 2.5% | T3x | 13.1 | 545 | 483 | 11.9 | 521 | 439 | 15.8 |
| 24HiMn | 2.5% | T351 | 2.5 | 526 | 411 | 18.0 | 482 | 357 | 22.0 |
| | 8% + 2.5% | T39 | 8.0 | 544 | 460 | 13.6 | 503 | 403 | 16.7 |
| | 12% + 2.5% | T3x | 12.1 | 561 | 506 | 9.6 | 528 | 448 | 13.1 |

Fracture toughness was evaluated by Kahn tear tests (see Table 5) and $K_{app}$ R-curve evaluation (see Table 6).

Kahn tear maximum stress $R_e$ of initiation energy $E_{init}$ (energy spent until the maximum stress is reached) are indicative of the plane stress fracture toughness performance (the specimen thickness is about 5 mm).

The $K_{app}$ evaluation is conducted on thin (6.35 mm-0.25") CT specimens (width 40 mm-1.6") and corresponds to testing conditions close to the R-curve.

Figure 4:
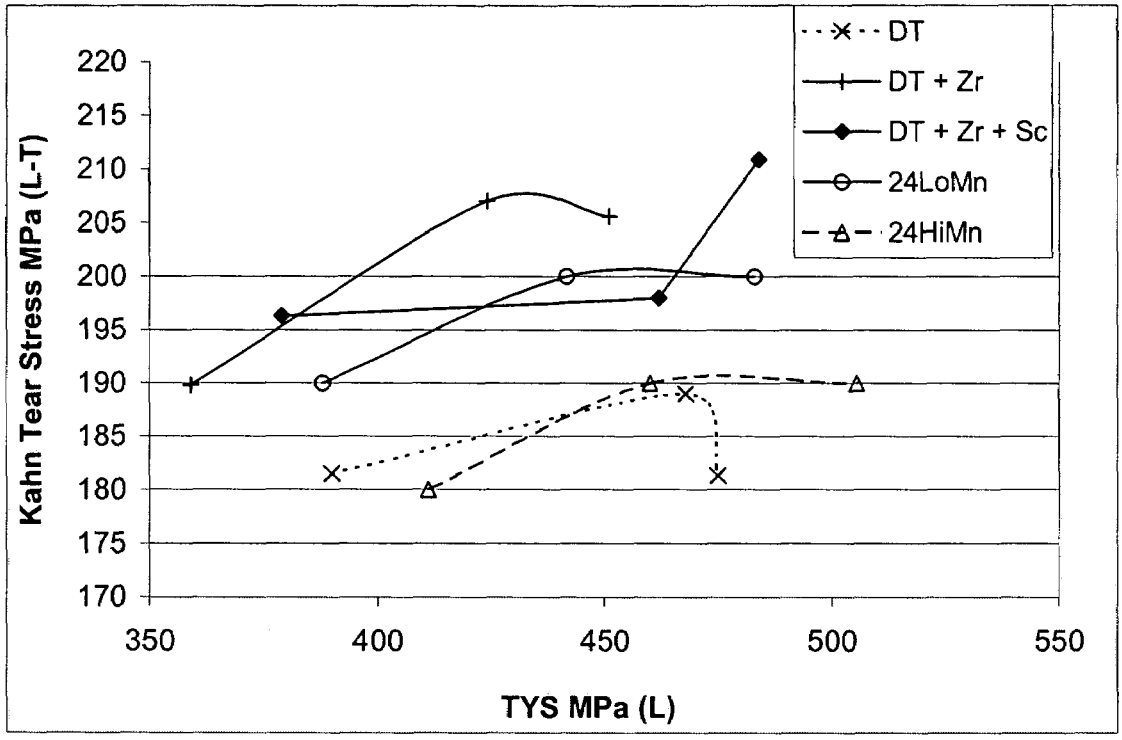
FIG. 4 shows the Kahn tear stress in L-T orientation as a function of TYS for the different alloys in T3X tempers.
Figure 5:
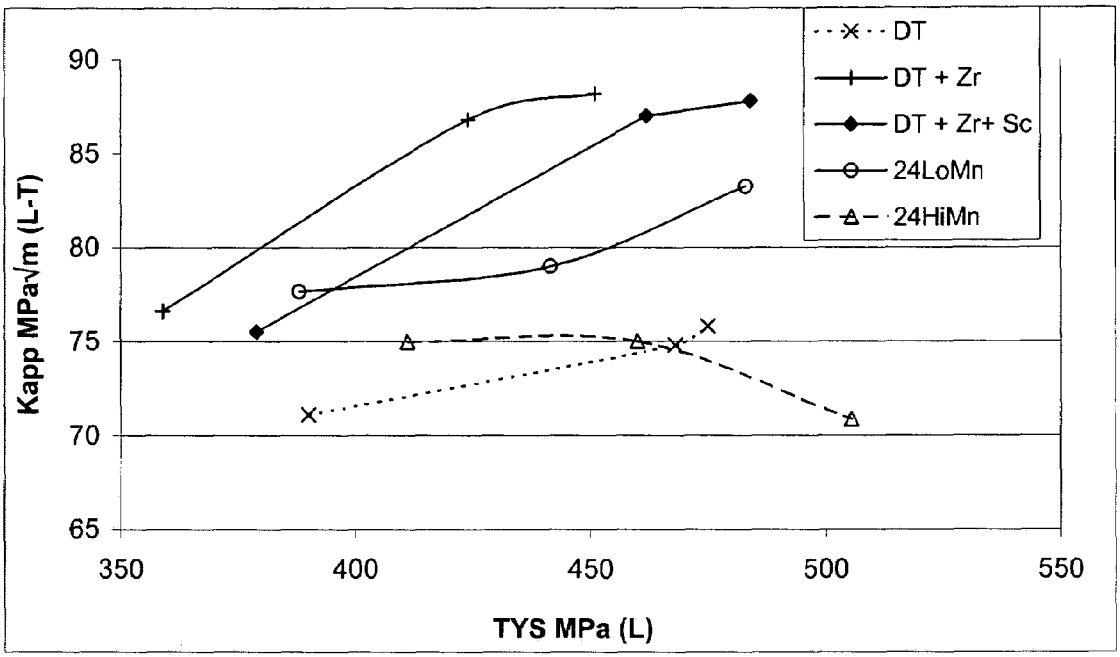
FIG. 5 shows the $K_{app}$ plane stress fracture toughness in L-T orientation as a function of TYS for the different alloys in T3X tempers.
Figure 6:
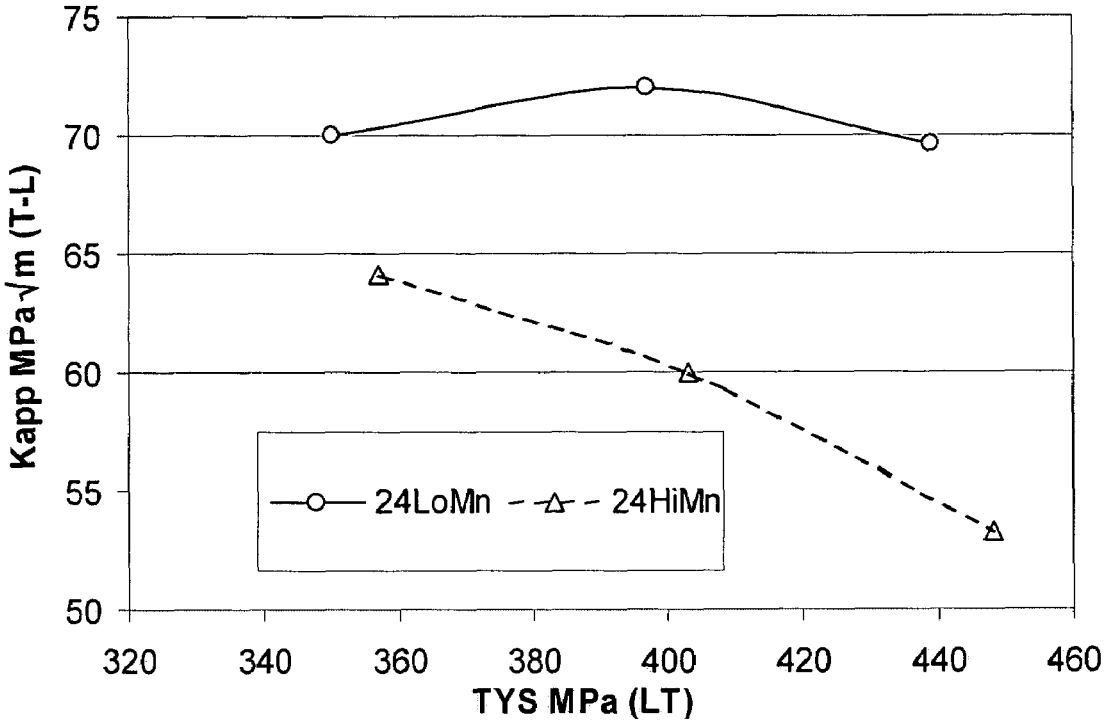
FIG. 6 shows the Kapp plane stress fracture toughness in T-L orientation as a function of TYS for some of the alloy in T3X tempers.

As for T3X fracture toughness results (FIGS. 4 to 6), the following comments can be made:

The evolution of toughness with tensile yield strength is very similar when considering the Kahn tear test or the $K_{app}$ determination.

Both in L-T and T-L orientations, the toughness performance seems to be clearly related to the manganese content: DT+Zr and DT+Zr+Sc with no manganese perform significantly better than the 0.3% Mn variant (24LoMn) which in turn represent an improvement over the higher manganese variants (DT, 24HiMn).

In most of the cases, fracture toughness increases with the amount of cold-work (i.e. the TYS-$K_{app}$ relationship is positive), which is very unexpected (cold-work decreases the material's intrinsic ductility, hence its toughness).

However, in cases where some manganese is present (see especially 24HiMn), a flat and even decreasing TYS-$K_{app}$ curve can be observed. This is especially true in the T-L orientation (see FIG. 6). It can thus be assumed that these alloys with high dispersoid content could be more sensitive to cold-work, possibly because of dispersoids fracture.

TABLE 5

Kahn measurements on T3X tempers

| Alloy | Process | Temper | Kahn Tear Test: Tear Stress [MPa] L-T | Tear Stress [MPa] T-L | Opening Energy [J] L-T | Opening Energy [J] T-L |
|---|---|---|---|---|---|---|
| DT | 2% | T351 | 181.5 | 174.5 | 26.7 | 22.9 |
| | 1% + 10% + 1% | T39 | 189.0 | 186.0 | 20.9 | 19.9 |
| | 1% + 13% + 1% | T3x | 181.3 | | 19.6 | |
| DT + | 2% | T351 | 189.8 | 185.5 | 46.7 | 43.0 |

TABLE 5-continued

Kahn measurements on T3X tempers

| Alloy | Process | Temper | Kahn Tear Test: Tear Stress [MPa] L-T | Tear Stress [MPa] T-L | Opening Energy [J] L-T | Opening Energy [J] T-L |
|---|---|---|---|---|---|---|
| Zr | 1% + 10% + 1% | T39 | 207.0 | 197.0 | 36.9 | 31.9 |
| | 1% + 13% + 1% | T3x | 205.6 | | 32.1 | |
| DT + | 2% | T351 | 196.3 | 189.0 | 54.8 | 49.1 |
| Zr + Sc | 1% + 10% + 1% | T39 | 198.0 | 193.0 | 36.7 | 30.3 |
| | 1% + 13% + 1% | T3x | 210.9 | | 34.4 | |
| 24LoMn | 2.5% | T351 | 190.0 | | 34.0 | |
| | 8% + 2.5% | T39 | 200.0 | | 30.0 | |
| | 12% + 2.5% | T3x | 200.0 | | 27.0 | |
| 24HiMn | 2.5% | T351 | 180.0 | | 29.0 | |
| | 8% + 2.5% | T39 | 190.0 | | 24.0 | |
| | 12% + 2.5% | T3x | 190.0 | | 19.5 | |

Figure 7:
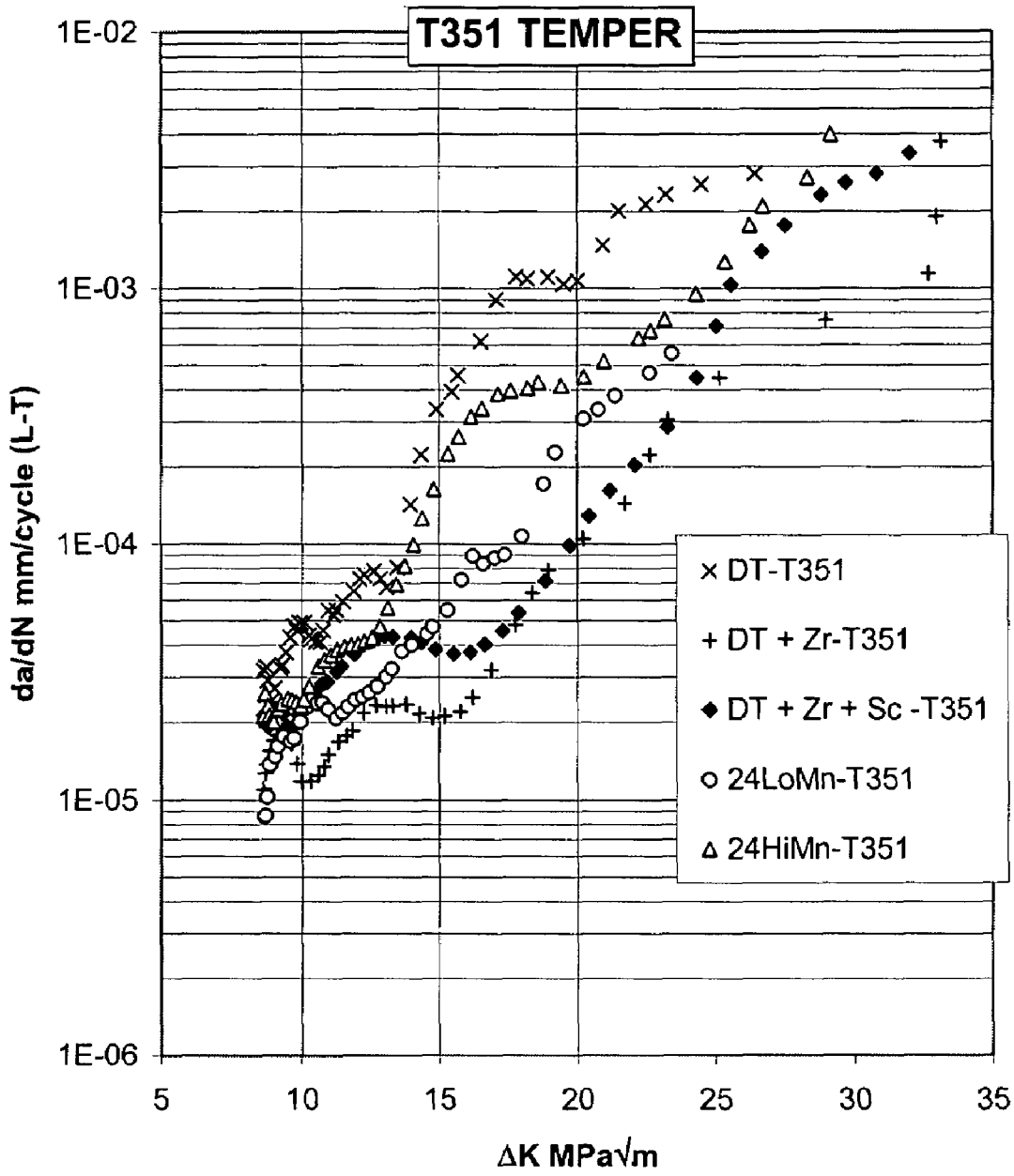
FIG. 7 shows ΔK-da/dN curves for the 2×24 type alloys in the T351 temper.
Figure 8:
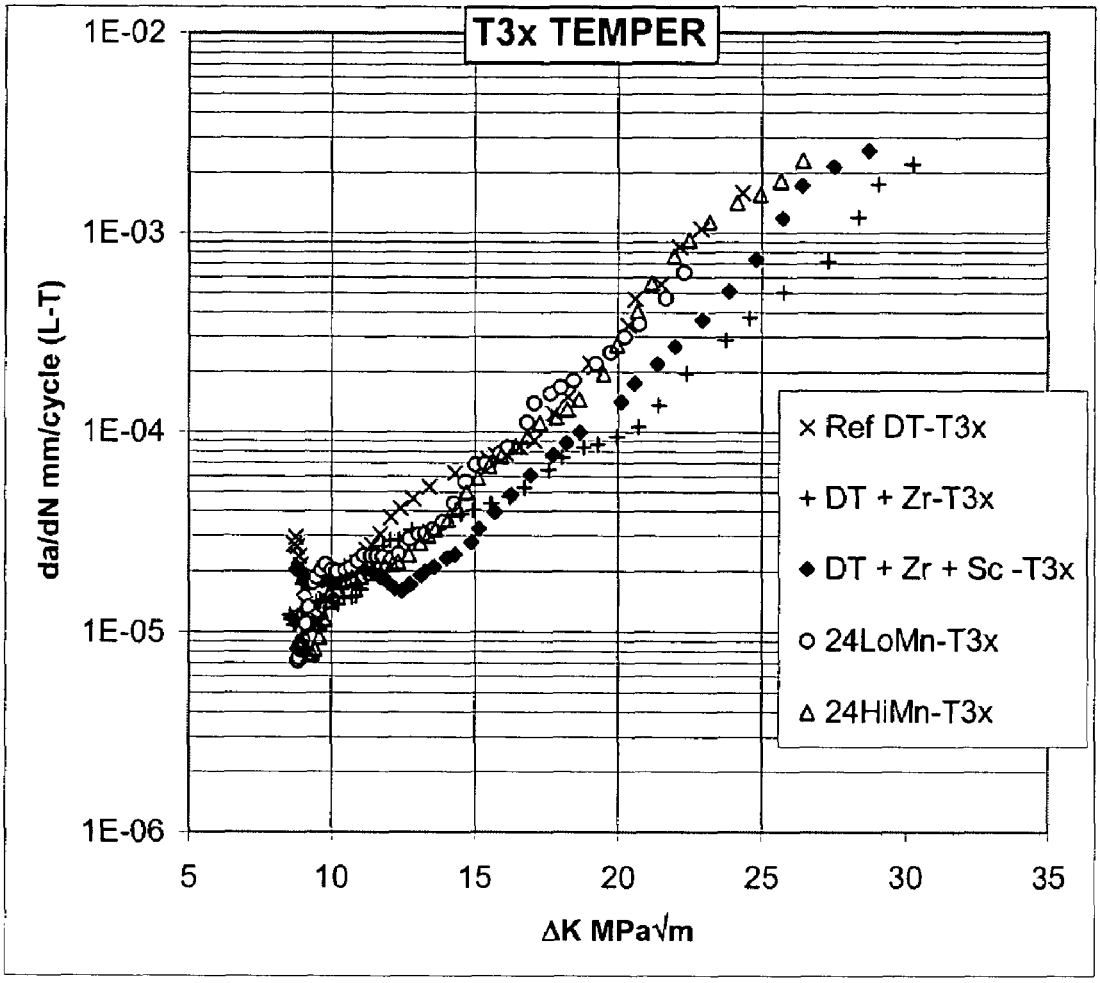
FIG. 8 shows ΔK-da/dN curves for the 2×24 type alloys in the T3x temper.

As regards the crack propagation performance of the alloys in T3X tempers, the following points can be stated (Table 6 and FIGS. 7 and 8):

At intermediate ΔK levels, manganese seems to play the major role for 2×24-type alloys; the higher the manganese content, the higher the crack propagation rate. It is assumed that, since manganese-rich dispersoids entail a homogenization of deformation, the fracture path is smooth. On the contrary, in the absence of these incoherent dispersoids, some crack roughness is developed (owing to localization of deformation on specific habit planes). Because of crack closure phenomena, this lowers the effective ΔK at the crack tip, entailing a slower propagation rate.

For the 2×24-type alloys, the effect of cold work on the propagation rate at intermediate ΔK levels is either not significant (DT+Zr+Sc with 0% Mn or 24LoMn with 0.3% Mn) or beneficial (24HiMn with 0.5% Mn or the incumbent DT).

TABLE 6

$K_{app}$ and da/dN measurements on 0.25" thick W = 1.6" CT specimens at T/2, in the L-T and T-L orientations for T3X tempers

| | | | $K_{app}$ test on CT 6.35 mm specimen [MPa√m] | | L-T FCGR(*) on CT 6.35mm specimen da/dN in mm/cycle at ΔK = [MPa√m] | | | |
|---|---|---|---|---|---|---|---|---|
| Alloy | Process | Temper | T-L | L-T | 10 | 15 | 25 | 30 |
| DT | 2% | T351 | | 71.1 | $4.2\ 10^{-5}$ | $3.6\ 10^{-4}$ | $2.6\ 10^{-3}$ | — |
| | 1% + 10% + 1% | T39 | | 74.8 | $2.3\ 10^{-5}$ | $1.3\ 10^{-4}$ | $1.3\ 10^{-3}$ | — |
| | 1% + 13% + 1% | T3x | | 75.8 | $1.4\ 10^{-5}$ | $7.3\ 10^{-5}$ | $2.0\ 10^{-3}$ | — |
| DT + | 2% | T351 | | 76.6 | $3.1\ 10^{-5}$ | $1.3\ 10^{-4}$ | $2.0\ 10^{-3}$ | — |
| Zr | 1% + 10% + 1% | T39 | | 86.8 | $1.5\ 10^{-5}$ | $2.1\ 10^{-5}$ | $4.5\ 10^{-4}$ | $7.5\ 10^{-4}$ |
| | 1% + 13% + 1% | T3x | | 88.2 | $1.4\ 10^{-5}$ | $4.0\ 10^{-5}$ | $3.7\ 10^{-4}$ | $1.8\ 10^{-3}$ |
| DT + | 2% | T351 | | 75.5 | $2.2\ 10^{-5}$ | $3.8\ 10^{-5}$ | $7.1\ 10^{-4}$ | $2.5\ 10^{-3}$ |
| Zr + Sc | 1% + 10% + 1% | T39 | | 87.0 | $2.6\ 10^{-5}$ | $4.7\ 10^{-5}$ | $6.6\ 10^{-4}$ | — |
| | 1% + 13% + 1% | T3x | | 87.8 | $1.8\ 10^{-5}$ | $3.0\ 10^{-5}$ | $7.4\ 10^{-4}$ | — |
| 24LoMn. | 2.5% | T351 | 70.0 | 77.6 | $1.5\ 10^{-5}$ | $3.8\ 10^{-5}$ | — | — |
| | 8% + 2.5% | T39 | 72.0 | 79.0 | $2.7\ 10^{-5}$ | $9.6\ 10^{-5}$ | $1.3\ 10^{-3}$ | $3.0\ 10^{-3}$ |
| | 12% + 2.5% | T3x | 69.6 | 83.3 | $1.7\ 10^{-5}$ | $4.8\ 10^{-5}$ | $5.2\ 10^{-4}$ | — |
| 24HiMn. | 2.5% | T351 | 64.1 | 75.0 | $1.9\ 10^{-5}$ | $2.0\ 10^{-4}$ | $1.2\ 10^{-3}$ | $4.0\ 10^{-3}$ |
| | 8% + 2.5% | T39 | 60.0 | 75.0 | $7.8\ 10^{-6}$ | $5.1\ 10^{-5}$ | $1.9\ 10^{-3}$ | — |
| | 12% + 2.5% | T3x | 53.3 | 70.9 | $1.2\ 10^{-5}$ | $4.3\ 10^{-5}$ | $1.4\ 10^{-3}$ | — |

(*)FCGR = Fatigue Crack Growth Rate

The exfoliation corrosion ratings after the EXCO test (ASTM G34) are given in Table 7. The alloys containing no manganese seem to be slightly more sensitive (espically the DT+Zr+Sc variant which shows a very oriented grain structure).

TABLE 7

EXCO (ASTM G34) rating for the different alloys in different tempers

| | | | EXCO Rating (ASTM G34) | |
|---|---|---|---|---|
| Alloy | Process | Temper | Surface | Half-thickness |
| DT | 2% | T351 | P | EA |
| DT + Zr | 2% | T351 | P | EA |
| DT + Zr + Sc | 2% | T351 | P | EB/EC |
| 24LoMn | 2% | T351 | N | P |
| 24HiMn | 2% | T351 | N | P/EA |

Example 3

Mechanical and Corrosion Evaluation in T8X Tempers

The alloys manufactured in Example 1 (various T3X tempers) were artificially aged to T8X tempers as explained in Example 1.

The high manganese variant named 24HiMn was not selected for the T78X evaluation, due to its relatively poor toughness.

Figure 9:
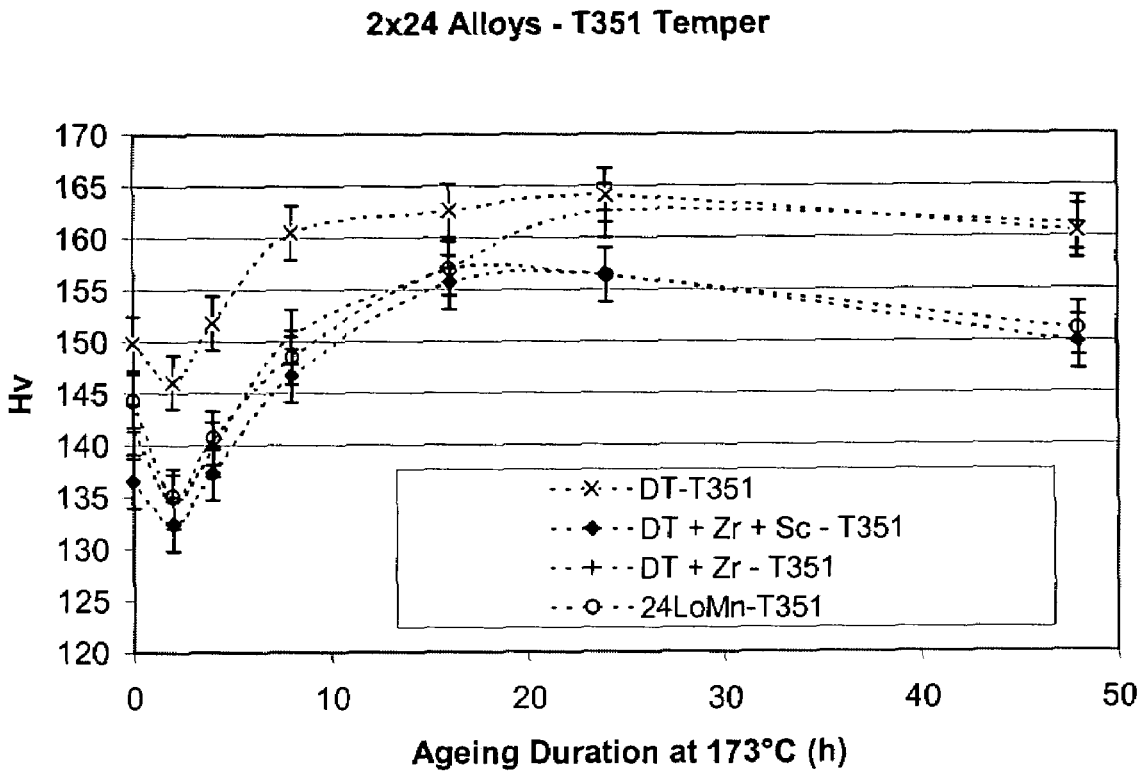
FIG. 9 shows ageing curves for various 2×24 alloys in the T351 temper.
Figure 10:
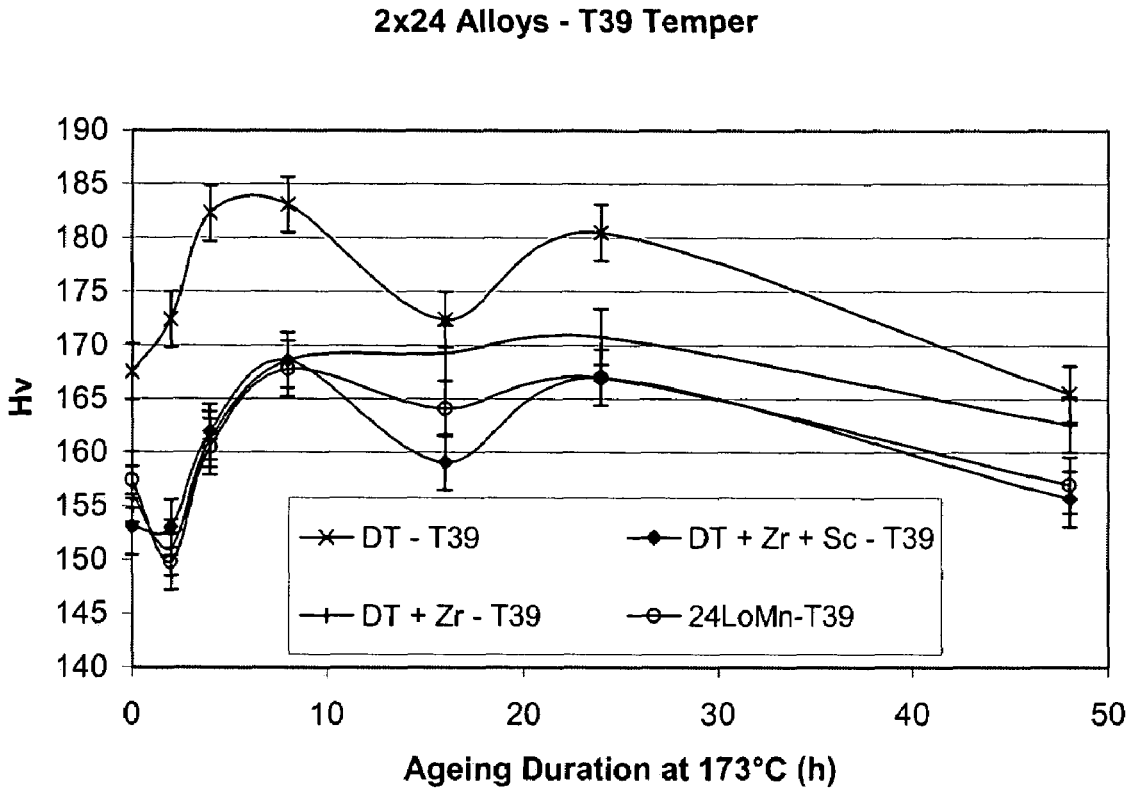
FIG. 10 shows ageing curves for various 2×24 alloys in the T39 temper.

Prior to the artificial aging treatment, aging kinetics (using Vickers hardness as a strength indicator) have been conducted on the various alloys in different T3X conditions. The results are provided in FIGS. 9 and 10.

On some of the cases (apparently independent of alloy chemistry and T3X temper), an initial decrease of hardness is observed for low ageing times; this is probably due to retrogression phenomena. Then, hardness increases, owing to precipitation hardening. A peak in hardness is generally observed, before hardness slowly decreases by over-ageing.

Table 8 below gives the aging treatment duration chosen for the complete characterization program in the T8X tempers.

TABLE 8

Ageing treatments chosen for the complete characterization in the T8X tempers

| Alloy | Process | Temper | Cold Work [%] | Ageing Time at 173 ° C. |
|---|---|---|---|---|
| DT | 2% | T851 | 2.0% | 20 h |
| | 1% + 10% | T89 | 11.8% | 10 h |
| DT + Zr | 2% | T851 | 2.0% | 20 h |
| | 1% + 10% | T89 | 11.8% | 10 h |
| DT + Zr + Sc | 2% | T851 | 2.0% | 20 h |
| | 1% + 10% | T89 | 11.6% | 10 h |
| 24LoMn | 2% | T851 | 2.0% | 20 h |
| | 8% + 2% | T89 | 8.3% | 20 h |

Figure 11:
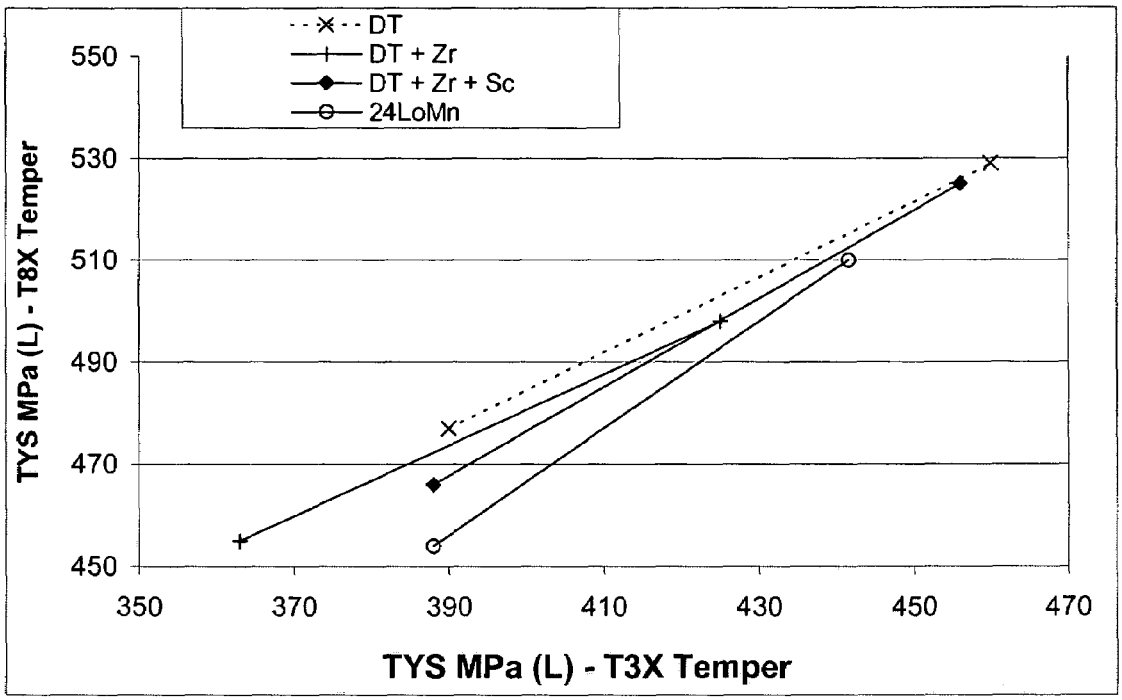
FIG. 11 shows the relationship between TYS in T3X and the corresponding T8X tempers.
Figure 12:
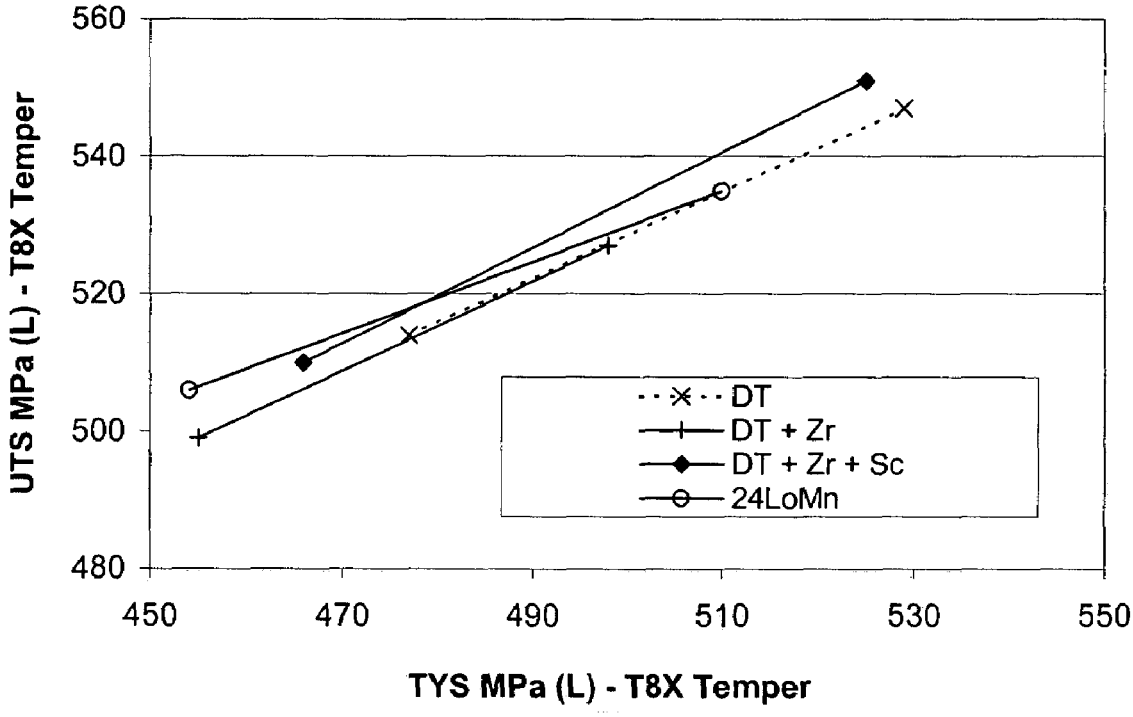
FIG. 12 shows the TYS-UTS relationship for the different 2×24 alloys in T8X tempers.

The static tensile properties in the T8X tempers are summarized in Table 9 and FIGS. 11 and 12.

TABLE 9

Static properties in various T8X tempers

| | | | | L orientation | | | | | |
|---|---|---|---|---|---|---|---|---|---|
| | | | Cold | T8X | | | For comparison: T3X | | |
| Alloy | Process | Temper | Work [%] | UTS MPa | TYS MPa | A [%] | UTS [MPa] | TYS [MPa] | A [%] |
| DT | 2% | T851 | 2.0 | 514 | 477 | 10 | 503 | 390 | 19.6 |
| | 1% + 10% + 1% | T89 | 11.8 | 547 | 529 | 8 | 539 | 468 | 11.7 |
| DT + Zr | 2% | T851 | 2.0 | 499 | 455 | 12 | 463 | 359 | 23 |
| | 1% + 10% + 1% | T89 | 11.8 | 527 | 498 | 11 | 500 | 424 | 15.4 |
| DT + | 2% | T851 | 2.0 | 510 | 466 | 13.6 | 498 | 379 | 20 |
| Zr + Sc | 1% + 10% + 1% | T89 | 11.6 | 551 | 525 | 14 | 532 | 462 | 13 |
| 24LoMn | 2% | T851 | 2.0 | 506 | 454 | 14 | 497 | 388 | 21 |
| | 8% + 2% | T89 | 8.3 | 535 | 510 | 12 | 525 | 442 | 15.6 |

Figure 13:
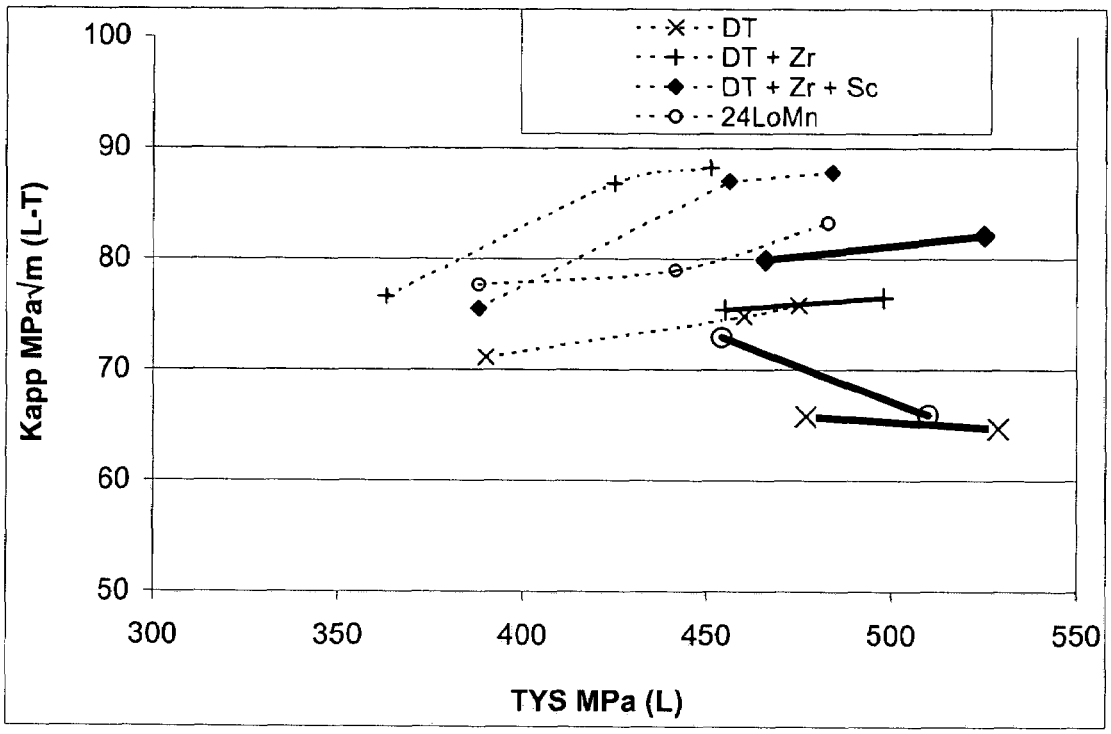
FIG. 13 shows the $K_{app}$ plane stress fracture toughness in L-T orientation as a function of TYS: summary of all the T3X (dotted lines, small symbols) and T8X (thick lines, large symbols) data.

Regarding the T8X fracture toughness results (Table 10 and FIG. 13):

First of all, the T8X fracture toughness is almost always inferior to that of the corresponding T3X temper. This is frequently observed in alloy products of the 2XXX series and corresponds to an overall decrease in ductility.

The only exception to this regards DT+Zr+Sc which shows a slightly higher toughness in the T851 temper than in the T351 condition.

The crack propagation behavior at low and medium ΔK levels is strongly degraded in the T8X tempers in comparison to the T3X performance. The reason is not totally clear, but could be related to the homogenization of deformation in artificially aged tempers.

There is very little influence of the degree of cold-work on the crack growth rate of T8X tempers.

When all the alloys are considered in the various T8X tempers, it is noticeable that their crack propagation performances are very similar.

TABLE 10

$K_{app}$ and da/dN measurements on 0.25" thick W = 1.6" CT specimens at T/2, in the L-T orientation for T8X tempers

| | | | $K_{app}$ test on CT 6.35mm specimen [MPa√m] | L-T FCGR on CT 6.35mm specimen da/dN in mm/cycle at ΔK = [MPa√m] | | | | |
|---|---|---|---|---|---|---|---|---|
| Alloy | Process | Temper | L-T | 10 | 15 | 20 | 25 | 30 |
| DT | 2% | T851 | 65.8 | $1.0\ 10^{-4}$ | $3.5\ 10^{-4}$ | $8.6\ 10^{-4}$ | $2.3\ 10^{-3}$ | $3.4\ 10^{-3}$ |
| | 1% + 10% + 1% | T89 | 64.7 | $3.1\ 10^{-5}$ | $2.8\ 10^{-4}$ | $1.0\ 10^{-3}$ | $2.1\ 10^{-3}$ | |
| DT + | 2% | T851 | 75.4 | $7.4\ 10^{-5}$ | $3.1\ 10^{-4}$ | $7.1\ 10^{-4}$ | $1.5\ 10^{-3}$ | $2.4\ 10^{-3}$ |
| Zr | 1% + 10% + 1% | T89 | 76.5 | $2.6\ 10^{-5}$ | $2.1\ 10^{-4}$ | $6.1\ 10^{-4}$ | $1.2\ 10^{-3}$ | $2.1\ 10^{-3}$ |
| DT + | 2% | T851 | 79.9 | $1.0\ 10^{-4}$ | $3.6\ 10^{-4}$ | $8.0\ 10^{-4}$ | $1.3\ 10^{-3}$ | $2.7\ 10^{-3}$ |
| Zr + Sc | 1% + 10% + 1% | T89 | 82.1 | $8.7\ 10^{-5}$ | $3.0\ 10^{-4}$ | $6.8\ 10^{-4}$ | $1.4\ 10^{-3}$ | $2.8\ 10^{-3}$ |
| 24LoMn | 2% | T851 | 72.9 | $1.1\ 10^{-4}$ | $3.7\ 10^{-4}$ | $7.8\ 10^{-4}$ | $1.7\ 10^{-3}$ | $3.3\ 10^{-3}$ |
| | 8% + 2% | T89 | 65.9 | $9.2\ 10^{-5}$ | $3.5\ 10^{-4}$ | $7.7\ 10^{-4}$ | $1.7\ 10^{-3}$ | $3.7\ 10^{-3}$ |

The TYS-$K_{app}$ relationships in the T8X tempers (linked to the amount of cold-work) are either "slightly positive" (DT+Zr+Sc, DT+Zr), "flat" (DT) or "negative" (24LoMn).

There is still a strong detrimental influence of manganese on fracture toughness in the T8X tempers.

As for the 2×24-type alloys, the loss in fracture toughness from T3X to T8X tempers is much more limited for the 0% Mn variant containing Zr+Sc (DT+Zr+Sc) than for the others: standard DT, 0% Mn with no scandium (DT+Zr) and 0.3% Mn with a Zr+Sc addition (24LoMn).

Figure 14:
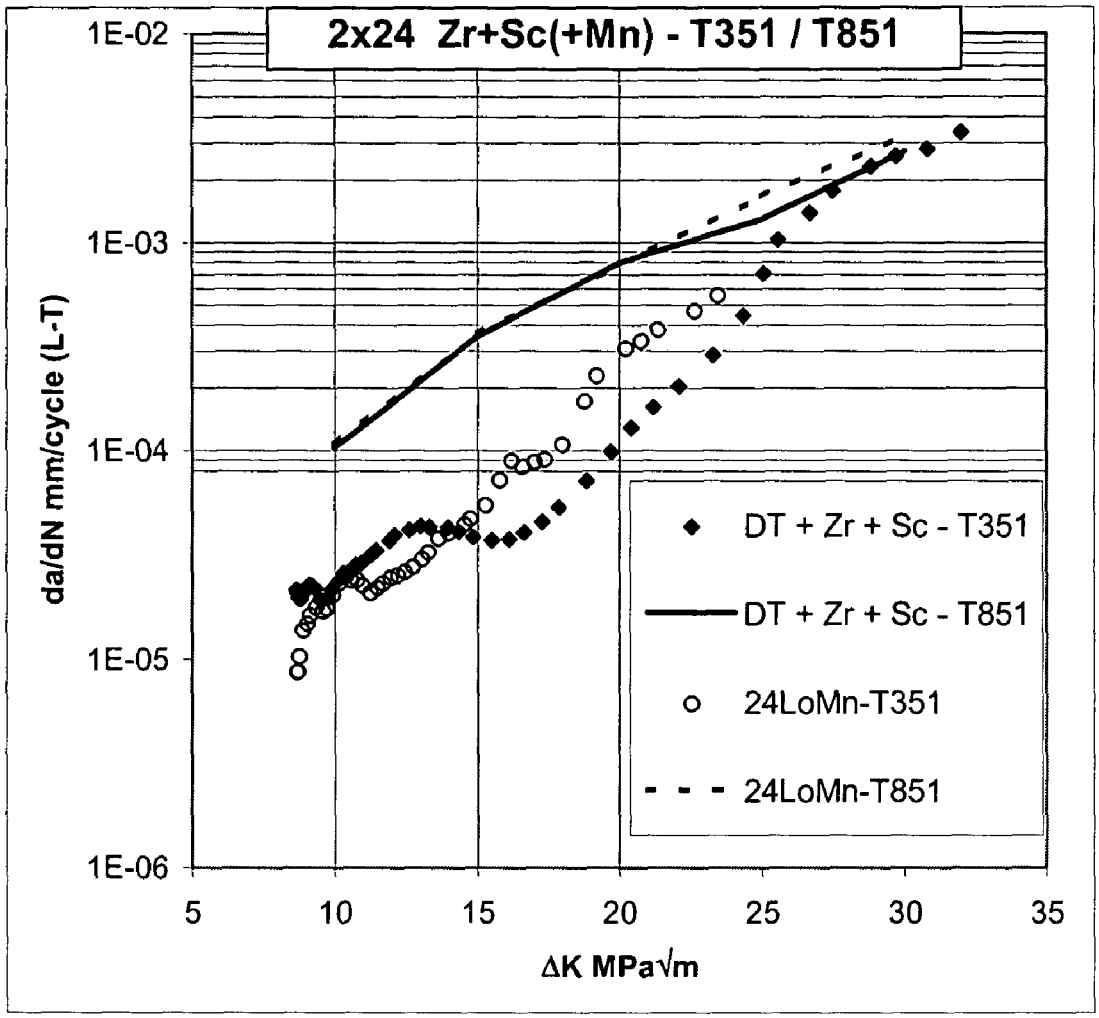
FIG. 14 shows ΔK-da/dN curves for some of the 2×24 alloys (containing Zr+Sc+0% Mn or 0.3% Mn) in T351 and T851 tempers.
Figure 15:
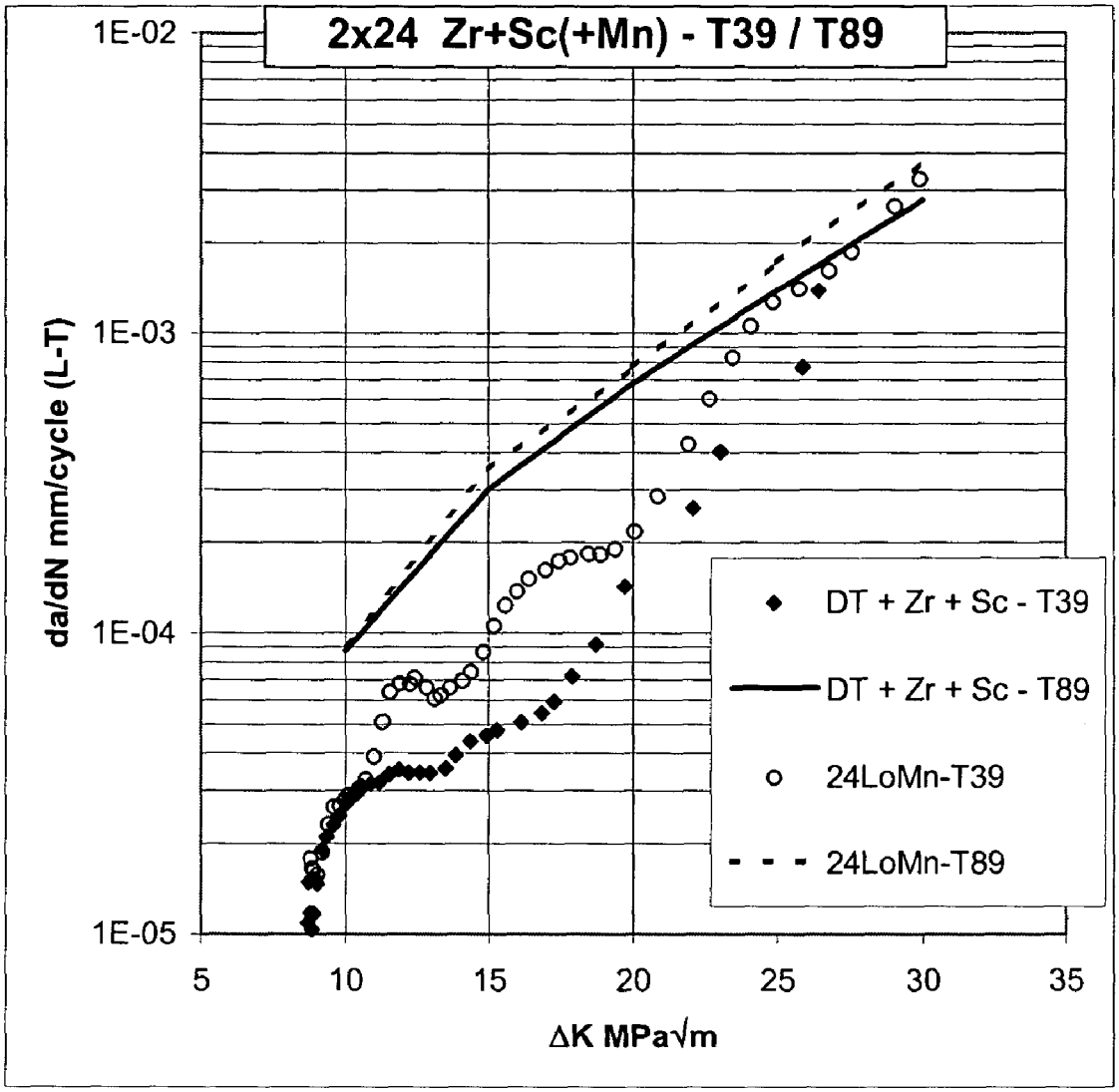
FIG. 15 shows ΔK-da/dN curves for some of the 2×24 alloys (containing Zr+Sc+0% Mn or 0.3% Mn) in T39 and T89 tempers.

As regards the crack propagation performance (FCGR=Fatigue Crack Growth Rate) of the alloys in T8X tempers (Table 10 and FIGS. 14 and 15):

Table 11 below summarizes the EXCO results obtained on the T8X tempers for the different alloys. The results obtained on the T351 tempers are recalled. In the T8X tempers, it is noticed that the corrosion susceptibility decreases from T851 to T89 tempers, provided that the ageing treatment is the same (20 h at 173° C.). This is probably due to a more extensive intragranular precipitation in the case of strongly cold-worked tempers. When such a strong cold-work is followed by a shorter ageing treatment, the intragranular precipitation is probably not very different (in terms of solute content decrease) from that of the T351 temper, and corrosion susceptibility is similar.

TABLE 11

EXCO (ASTM G34) rating for the different alloys in different tempers

| Alloy | Process | Temper | EXCO Rating (ASTM G34) Surface | EXCO Rating (ASTM G34) T/2 |
|---|---|---|---|---|
| DT | 2% | T351 | P | EA |
| | 2% | T851 | EB | EA/EB |
| | 1% + 10% + 1% | T89* | EB/EC | EA/EB |
| DT + Zr | 2% | T351 | P | EA |
| | 2% | T851 | EB | EA/EB |
| | 1% + 10% + 1% | T89* | EC | EA/EB |
| DT + Zr + Sc | 2% | T351 | P | EB/EC |
| | 2% | T851 | EB/EC | EB |
| | 1% + 10% + 1% | T89* | EB/EC | EB/EC |
| 24LoMn | 2% | T351 | N | P |
| | 2% | T851 | EC | EB/EC |
| | 8% + 2% | T89 | EB | EB |

*shorter ageing treatment

Example 4

Fuselage Skin Sheets

Two alloys N and M with a chemical composition according to the invention were elaborated. The liquid metal was treated firstly in the holding furnace by injecting gas using a type of rotor known under the trade mark IRMA, and then in a type of ladle known under the trade mark Alpur. Refining was done with AT5B wire (0.7 kg/ton). 3.2 m-long ingots were cast, with a section of 320 mm×120 mm. They were relaxed for 10 h at 350° C.

The ingots were then homogenized at 500° C. for 12 hours and then hot rolled to a thickness of 6 mm. The exit temperature from the hot rolling mill was between 230° C. and 255° C. From ingot N, four sheets labeled N1, N2, N3 and N4 were obtained in this way. They were all solution heat treated in a salt bath furnace for 1 hour at 500° C., and then water quenched. Up to this point, the five sheets M, N1, N2, N3 and N4 were elaborated by the same process.

M and N1 were stretched with a permanent set of 2%; M and N1 correspond thus to a T351 temper.

N2 was cold rolled with a reduction of 7 to 8%, and then stretched with a permanent set of 2% ; N2 corresponds thus to a T39 temper.

N3 was stretched with a permanent set of 2% and then aged at 173° C. during 10 hours; N3 corresponds thus to a T851 temper.

N4 was cold rolled with a reduction of 7 to 8%, stretched with a permanent set of 2%, and finally aged at 173° C. during 10 hours; N4 corresponds thus to a T89 temper.

An alloy E according to prior art was elaborated using the same casting and hot rolling process as for alloy N. Solution heat treatment was done in a salt bath furnace for 1 hour at 500° C. on test coupons of size 600 mm×200 mm, followed by quenching in water (about 20° C.) and stretching to a permanent set of 2% (temper T351).

The chemical compositions of the alloys N and E alloys measured on a spectrometry slug taken from the launder, are given in Table 12:

TABLE 12

Chemical composition

| Alloy | Si | Fe | Cu | Mn | Mg | Zr | Sc |
|---|---|---|---|---|---|---|---|
| M | <0.06 | 0.06 | 3.81 | 0.008 | 1.41 | 0.11 | — |
| N | <0.06 | 0.07 | 3.81 | 0.008 | 1.36 | 0.11 | 0.028 |
| E | <0.06 | 0.06 | 4.12 | 0.4 | 1.37 | — | — |

No zinc and chromium were detected.

The ultimate tensile strength (UTS) $R_m$ (in MPa), the tensile yield stress (TYS) at 0.2% elongation $R_{p0.2}$ (in MPa) and the elongation at failure A (in %) were measured by a tensile test according to EN 10002-1.

Table 13 contains the results of measurements of static mechanical characteristics:

TABLE 13

Static mechanical characteristics

| | L direction | | | LT direction | | |
|---|---|---|---|---|---|---|
| Sheet | UTS $R_m$ [MPa] | TYS $R_{p0,2}$ [MPa] | A [%] | UTS $R_m$ [MPa] | TYS $R_{p0,2}$ [MPa] | A [%] |
| M | 463 | 348 | 27.4 | 453 | 312 | 26.7 |
| N1 | 459 | 349 | 23.8 | 446 | 313 | 25.8 |
| E | 482 | 365 | 22.8 | 466 | 319 | 23.5 |
| N2 | 478 | 436 | 13 | 473 | 393 | 15 |
| N3 | 472 | 409 | 15.4 | 460 | 383 | 17 |
| N4 | 521 | 501 | 11.4 | 509 | 469 | 13.2 |

The UTS and TYS of sheets M and N1, according to the invention, are almost comparable to those of sheet E, according to prior art, but their elongation is significantly higher. Sheet N2 (T39 temper), N3 (T851 temper) and especially N4 (T89 temper) exhibit improved mechanical properties compared to sheets M, N1 and E, as well as elongation values which are deemed sufficient for the application as fuselage skin sheet.

Damage tolerance was characterized in the T-L direction using the maximum stress $R_e$ (in MPa) and the creep energy $E_{ec}$ as derived from the Kahn test. The Kahn stress is equal to the ratio of the maximum load $F_{max}$ that the test piece can resist on the cross section of the test piece (product of the thickness B and the width W). The creep energy is determined as the area under the Force-Displacement curve as far as the maximum force $F_{max}$ resisted by the test piece. The Kahn test, well known to one skilled in the art, is described in the article "Kahn-Type Tear Test and Crack Toughness of Aluminum Alloy Sheet" published in the Materials Research & Standards Journal, April 1964, p. 151-155. The content of said article is incorporated herein by reference in its entirety. The test piece used for the Kahn toughness test is described in the "Metals Handbook", $8^{th}$ Edition, vol. 1, American Society for Metals, pp. 241-242. The results are given in table 14:

TABLE 14

Results derived from the Kahn test

| Sheet | $R_e$ [MPa] (T-L) | $E_e$ [J] (T-L) |
|---|---|---|
| M | 185 | — |
| N1 | 184 | 47.4 |
| E | 177 | 35.1 |

The maximum stress to which sheet N1 is capable of resisting is higher that that of sheet E, for a higher creep energy.

Fracture toughness was also determined for sheets N1, N2, N3, N4 and E by a measurement of the plane stress fracture toughness $K_{app}$ according to ASTM E 561 in the T-L direction using C(T) test pieces with W=127 mm. Results are given in table 15.

TABLE 15

$K_{app}$ results

| Sheet | $K_{app}$ [MPa√m] |
|---|---|
| M | 112 |
| N1 | 112 |
| N2 | 113 |
| N3 | 118 |
| N4 | 112 |
| E | 105 |

The sheet according to the present invention, and especially in T851 temper (sheets N3), show significantly improved $K_{app}$ values.

Fatigue resistance was determined according to ASTM E 647, by measuring the fatigue crack growth rate using C(T) test pieces with W=75 mm. The fatigue crack growth rate da/dN (in mm/cycle) for different levels of ΔK (expressed in MPa√m) was determined. Results are displayed in table 16.

TABLE 16

Fatigue resistance

| | da/dN at ΔK (MPa√m), T-L direction, ($10^{-4}$mm/cycles) | | | | |
|---|---|---|---|---|---|
| Sheet | 10 MPa√m | 15 MPa√m | 20 MPa√m | 25 MPa√m | 30 MPa√m |
| M | 1.21 | 3.46 | 7.27 | 12.9 | 20.7 |
| N1 (invention) | 1.18 | 3.53 | 7.68 | 14 | 22.9 |
| N2 (invention) | 1.1 | 3.6 | 8.2 | 14.4 | 30.1 |
| N3 (invention) | 1.4 | 4.0 | 8.4 | 13.8 | 23.4 |
| N4 (invention) | 1.1 | 3.4 | 7.7 | 11.8 | 26.3 |
| E (prior art) | 1.4 | 4.3 | 9.6 | 17.8 | 29.6 |

All sheets according to the invention have a fatigue crack growth rate at least as good as sheet E according to prior art, most are significantly better, and especially sheets M and N1.

Corrosion resistance was evaluated according ASTM G 110. After etching and polishing, the maximum depth of corrosion attack was evaluated. All samples exhibited intergranular corrosion attack, but the maximum depth of corrosion was only 40 μm for N2, 165 μm for N3, 180 μm for N4 and 225 μm for N1, whereas sample E according to prior art exhibited a maximum depth of 350 μm. Sample N2 also showed pitting, but at maximum depth not exceeding 60 μm.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

All documents referred to herein are specifically incorporated herein by reference in their entireties.

What we claim is:

1. A substantially manganese-free aluminum alloy rolled plate product, said plate product comprising a thickness of at least 12 mm and being formed from an alloy consisting essentially of (in percent by weight): Cu 3.8-4.2%, Mg 1.0-1.6%, Zr 0.08-0.20%, about 300 ppm Sc Fe up to 0.08%, Si up to 0.09%, Mn less than 0.05%, remainder aluminum and incident impurities.

2. An aluminum alloy rolled plate product according to claim 1, wherein Zr is present in an amount from 0.08-0.14%.

3. An aluminum alloy rolled plate product according to claim 2, having a recrystallized volume fraction of 5% maximum.

4. An aluminum alloy rolled plate product according to claim 2, wherein Mn is present in an amount of <0.01%.

5. An aluminum alloy rolled plate product according to claim 2, comprising at least one of the following combinations of properties:

a. a tensile yield strength in the longitudinal direction ($TYS_{(L)}$) of more than 400 MPa, and an apparent fracture toughness $K_{app(T-L)}$ of more than 110 MPa√m, measured according to ASTM E 561 in the T-L orientation on a specimen with a width of W=127 mm;

b. an ultimate tensile strength in the longitudinal direction ($UTS_{(L)}$) of more than 450 MPa, and an elongation at fracture in the longitudinal direction of more than 24%;

c. a tensile yield strength in the longitudinal direction ($TYS_{(L)}$) of more than 400 MPa, and a Kahn stress $R_e$ of at least 180 MPa.

6. An aluminum alloy rolled plate product according to claim 2, comprising a plate comprising at least one of the following combinations of properties:

a. a $UTS_{(L)}$ of more than 500 MPa, and a $K_{app(T-L)}$ of more than 75 MPa√m, measured according to ASTM E 647 on a 6.35 mm thick C(T) specimen with a width of W=40 mm;

b. a tensile yield strength in the longitudinal direction ($TYS_{(L)}$) of more than 450 MPa, and a $K_{app(L-T)}$ of more than 77 MPa√m, measured according to ASTM E 561 on a 6.35 mm thick C(T) specimen with a width of W=40 mm;

c. a tensile yield strength in the longitudinal direction ($TYS_{(L)}$) of more than 350 MPa, and a Kahn stress $R_e$ of at least 190 MPa.

7. An aluminum alloy rolled plate product according to claim 2, comprising a plate in T351 temper having a da/dn in T-L direction which fulfills at least one of the following conditions:

da/dn less than 3.0 $10^{-5}$ mm/cycles at $\Delta K=10$ MPa$\sqrt{m}$,
da/dn less than 1.0 $10^{-4}$ mm/cycles at $\Delta K=15$ MPa$\sqrt{m}$,
da/dn less than 1.0 $10^{-3}$ mm/cycles at $\Delta K=25$ MPa$\sqrt{m}$,
da/dn less than 3 $10^{-3}$ mm/cycles at $\Delta K=30$ MPa$\sqrt{m}$.

8. An aluminum alloy rolled plate product according to claim 2, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

9. An aluminum alloy rolled plate product according to claim 2, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

10. A lower wing skin structural member made in an aluminum alloy rolled plate product according to claim 2.

11. A method for obtaining an aluminum alloy rolled product according to claim 2, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

12. An aluminum alloy rolled plate product according to claim 1, wherein Zr is present in an amount from 0.10-0.14%.

13. An aluminum alloy rolled plate product according to claim 12, having a recrystallized volume fraction of 5% maximum.

14. An aluminum alloy rolled plate product according to claim 12, wherein Mn is present in an amount of <0.01%.

15. An aluminum alloy rolled plate product according to claim 4, comprising at least one of the following combinations of properties:

a. tensile yield strength in the longitudinal direction ($TYS_{(L)}$) of more than 400 MPa, and an apparent fracture toughness $K_{app(TL)}$ of more than 110 MPa$\sqrt{m}$, measured according to ASTM E 561 in the T-L orientation on a specimen with a width of W=127 mm;

b. an ultimate tensile strength in the longitudinal direction ($UTS_{(L)}$) of more than 450 MPa, and an elongation at fracture in the longitudinal direction of more than 24%;

c. a tensile yield strength in the longitudinal direction ($TYS_{(L)}$) of more than 400 MPa, and a Kahn stress $R_e$ of at least 180 MPa.

16. An aluminum alloy rolled plate product according to claim 12, comprising a plate comprising at least one of the following combinations of properties:

a. a $UTS_{(L)}$ of more than 500 MPa, and a $K_{app(T-L)}$ of more than 75 MPa$\sqrt{m}$, measured according to ASTM E 647 on a 6.35 mm thick C(T) specimen with a width of W=40 mm;

b. a tensile yield strength in the longitudinal direction ($TYS_{(L)}$) of more than 450 MPa, and a $K_{app(L-T)}$ of more than 77 MPa$\sqrt{m}$, measured according to ASTM E 561 on a 6.35 mm thick C(T) specimen with a width of W=40 mm;

c. a tensile yield strength in the longitudinal direction ($TYS_{(L)}$) of more than 350 MPa, and a Kahn stress $R_e$ of at least 190 MPa.

17. An aluminum alloy rolled plate product according to claim 12, comprising a plate in T351 temper having a da/dn in T-L direction which fulfills at least one of the following conditions:

da/dn less than 3.0 $10^{-5}$ mm/cycles at $\Delta K=10$ MPa$\sqrt{m}$,
da/dn less than 1.0 $10^{-4}$ mm/cycles at $\Delta K=15$ MPa$\sqrt{m}$,
da/dn less than 1.0 $10^{-3}$ mm/cycles at $\Delta K=25$ MPa$\sqrt{m}$,
da/dn less than 3 $10^{-3}$ mm/cycles at $\Delta K=30$ MPa$\sqrt{m}$.

18. An aluminum alloy rolled plate product according to claim 12, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

19. An aluminum alloy rolled plate product according to claim 12, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

20. A lower wing skin structural member made in an aluminum alloy rolled plate product according to claim 12.

21. A method for obtaining an aluminum alloy rolled product according to claim 12, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

22. An aluminum alloy rolled plate product according to claim 1, having a recrystallized volume fraction of 5% maximum.

23. An aluminum alloy rolled plate product according to claim 22, wherein Mn is present in an amount of <0.01%.

24. An aluminum alloy rolled plate product according to claim 22, comprising a plate comprising at least one of the following combinations of properties:

a. a $UTS_{(L)}$ of more than 500 MPa, and a $K_{app(T-L)}$ of more than 75 MPa$\sqrt{m}$, measured according to ASTM E 647 on a 6.35 mm thick C(T) specimen with a width of W=40 mm;

b. a tensile yield strength in the longitudinal direction ($TYS_{(L)}$) of more than 450 MPa, and a $K_{app(L-T)}$ of more than 77 MPa$\sqrt{m}$, measured according to ASTM E 561 on a 6.35 mm thick C(T) specimen with a width of W=40 mm;

c. a tensile yield strength in the longitudinal direction ($TYS_{(L)}$) of more than 350 MPa, and a Kahn stress $R_e$ of at least 190 MPa.

25. An aluminum alloy rolled plate product according to claim 22, comprising a plate in T351 temper having a da/dn in T-L direction which fulfills at least one of the following conditions:

da/dn less than 3.0 $10^{-5}$ mm/cycles at $\Delta K$=10 MPa$\sqrt{m}$,
da/dn less than 1.0 $10^{-4}$ mm/cycles at $\Delta K$=15 MPa$\sqrt{m}$,
da/dn less than 1.0 $10^{-3}$ mm/cycles at $\Delta K$=25 MPa$\sqrt{m}$,
da/dn less than 3 $10^{-3}$ mm/cycles at $\Delta K$=30 MPa$\sqrt{m}$.

26. An aluminum alloy rolled plate product according to claim 22, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

27. An aluminum alloy rolled plate product according to claim 22, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

28. A lower wing skin structural member made in an aluminum alloy rolled plate product according to claim 22.

29. A method for obtaining an aluminum alloy rolled product according to claim 22, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

30. An aluminum alloy rolled plate product according to claim 1, wherein Mn is present in an amount of <0.01%.

31. An aluminum alloy rolled plate product according to claim 30, comprising a plate comprising at least one of the following combinations of properties:

a. a $UTS_{(L)}$ of more than 500 MPa, and a $K_{app(T-L)}$ of more than 75 MPa$\sqrt{m}$, measured according to ASTM E 647 on a 6.35 mm thick C(T) specimen with a width of W=40 mm;

b. a tensile yield strength in the longitudinal direction ($TYS_{(L)}$) of more than 450 MPa, and a $K_{app(L-T)}$ of more than 77 MPa$\sqrt{m}$, measured according to ASTM E 561 on a 6.35 mm thick C(T) specimen with a width of W=40 mm;

c. a tensile yield strength in the longitudinal direction ($TYS_{(L)}$) of more than 350 MPa, and a Kahn stress $R_e$ of at least 190 MPa.

32. An aluminum alloy rolled plate product according to claim 30, comprising a plate in T351 temper having a da/dn in T-L direction which fulfills at least one of the following conditions:

da/dn less than 3.0 $10^{-5}$ mm/cycles at $\Delta K$=10 MPa$\sqrt{m}$,
da/dn less than 1.0 $10^{-4}$ mm/cycles at $\Delta K$=15 MPa$\sqrt{m}$,
da/dn less than 1.0 $10^{-3}$ mm/cycles at $\Delta K$=25 MPa$\sqrt{m}$,
da/dn less than 3 $10^{-3}$ mm/cycles at $\Delta K$=30 MPa$\sqrt{m}$.

33. An aluminum alloy rolled plate product according to claim 30, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

34. An aluminum alloy rolled plate product according to claim 30, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

35. A lower wing skin structural member made in an aluminum alloy rolled plate product according to claim 30.

36. A method for obtaining an aluminum alloy rolled product according to claim 30, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

37. An aluminum alloy rolled plate product according to claim 1, comprising at least one of the following combinations of properties a. a tensile yield strength in the longitudinal direction ($TYS_{(L)}$) of more than 400 MPa, and an apparent fracture toughness $K_{app(T-L)}$ of more than 110 MPa$\sqrt{m}$, measured according to ASTM E 561 in the T-L orientation on a specimen with a width of W=127 mm;

b. an ultimate tensile strength in the longitudinal direction ($UTS_{(L)}$) of more than 450 MPa, and an elongation at fracture in the longitudinal direction of more than 24%;

c. a tensile yield strength in the longitudinal direction ($TYS_{(L)}$) of more than 400 MPa, and a Kahn stress $R_e$ of at least 180 MPa.

38. An aluminum alloy rolled plate product according to claim 37, comprising a plate comprising at least one of the following combinations of properties:

a. a $UTS_{(L)}$ of more than 500 MPa, and a $K_{app(T-L)}$ of more than 75 MPa$\sqrt{m}$, measured according to ASTM E 647 on a 6.35 mm thick C(T) specimen with a width of W=40 mm;

b. a tensile yield strength in the longitudinal direction ($TYS_{(L)}$) of more than 450 MPa, and a $K_{app(L-T)}$ of more than 77 MPa$\sqrt{m}$, measured according to ASTM E 561 on a 6.35 mm thick C(T) specimen with a width of W=40 mm;

c. a tensile yield strength in the longitudinal direction ($TYS_{(L)}$) of more than 350 MPa, and a Kahn stress $R_e$ of at least 190 MPa.

39. An aluminum alloy rolled plate product according to claim 37, comprising a plate in T351 temper, having a da/dn in T-L direction which fulfills at least one of the following conditions:

da/dn less than 3.0 $10^{-5}$ mm/cycles at $\Delta K=10$ MPa$\sqrt{m}$,
da/dn less than 1.0 $10^{-4}$ mm/cycles at $\Delta K=15$ MPa$\sqrt{m}$,
da/dn less than 1.0 $10^{-3}$ mm/cycles at $\Delta K=25$ MPa$\sqrt{m}$,
da/dn less than 3 $10^{-3}$ mm/cycles at $\Delta K=30$ MPa$\sqrt{m}$.

40. An aluminum alloy rolled plate product according to claim 37, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

41. An aluminum alloy rolled plate product according to claim 37, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

42. A lower wing skin structural member made in an aluminum alloy rolled plate product according to claim 37.

43. A method for obtaining an aluminum alloy rolled plate product according to claim 37, wherein said rolled plate product comprises a plate, said method comprising:

Casting a rolling ingot, followed by optional stress relieving, and scalping,
Homogenizing at a temperature between 450 and 510° C.,
Hot-rolling on a reversing mill, preferably with an exit temperature between 350 and 390° C.,
Optionally, for plate with a thickness of less than about 30 mm, conducting at least one intermediate reheating to about 480° C., followed by one or more hot-rolling passes, the final exit temperature optionally being between 350 and 370° C.,
Solution heat treating at a temperature between 490 and 510° C., followed by water quenching and natural aging,
Cold working by stretching alone or cold rolling followed by stretching, optionally followed by artificial aging.

44. An aluminum alloy rolled plate product according to claim 1 comprising a plate having at least one of the following combinations of properties a. a $UTS_{(L)}$ of more than 500 MPa, preferably more than 520 Mpa, and even more preferably more than 530 Mpa, and a $K_{app(T-L)}$ of more than 75 Mpa$\sqrt{m}$, measured according to ASTM E 647 on a 6.35 mm thick C(T) specimen with a width of W=40 mm;
b. a tensile yield strength in the longitudinal direction ($TYS_{(L)}$) of more than 450 Mpa, and preferably more than 460 Mpa, and a $K_{app(L-T)}$ of more than 77 Mpa$\sqrt{m}$, measured according to ASTM E 561 on a 6.35 mm thick C(T) specimen with a width of W=40 mm;
c. a tensile yield strength in the longitudinal direction ($TYS_{(L)}$) of more than 350 MPa, preferably more than 400 MPa and even more preferably more than 450 MPa, and a Kahn stress $R_e$ of at least 190 MPa.

45. An aluminum alloy rolled plate product according to claim 44, comprising a plate in T351 temper having a da/dn in T-L direction which fulfills at least one of the following conditions:

da/dn less than 3.0 $10^{-5}$ mm/cycles at $\Delta K=10$ MPa$\sqrt{m}$,
da/dn less than 1.0 $10^{-4}$ mm/cycles at $\Delta K=15$ MPa$\sqrt{m}$,
da/dn less than 1.0 $10^{-3}$ mm/cycles at $\Delta K=25$ MPa$\sqrt{m}$,
da/dn less than 3 $10^{-3}$ mm/cycles at $\Delta K=30$ MPa$\sqrt{m}$.

46. An aluminum alloy rolled plate product according to claim 44, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

47. An aluminum alloy rolled plate product according to claim 44, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

48. A lower wing skin structural member made in an aluminum alloy rolled plate product according to claim 44.

49. A method for obtaining an aluminum alloy rolled product according to claim 44, wherein said rolled product comprises a plate, said method comprising:

Casting a rolling ingot, followed by optional stress relieving, and scalping,
Homogenizing at a temperature between 450 and 510° C.,
Hot-rolling on a reversing mill, preferably with an exit temperature between 350 and 390° C.,
Optionally, for plate with a thickness of less than about 30 mm, conducting at least one intermediate reheating to about 480° C., followed by one or more hot-rolling passes, the final exit temperature optionally being between 350 and 370° C.,
Solution heat treating at a temperature between 490 and 510° C., followed by water quenching and natural aging,
Cold working by stretching alone or cold rolling followed by stretching, optionally followed by artificial aging.

50. An aluminum alloy rolled plate product according to claim 1 comprising a plate in T351 temper having a da/dn in T-L direction which fulfills at least one of the following conditions:

da/dn less than 3.0 $10^{-5}$ mm/cycles at $\Delta K=10$ MPa$\sqrt{m}$,
da/dn less than 1.0 $10^{-4}$ mm/cycles at $\Delta K=15$ MPa$\sqrt{m}$,
da/dn less than 1.0 $10^{-3}$ mm/cycles at $\Delta K=25$ MPa$\sqrt{m}$,
da/dn less than 3 $10^{-3}$ mm/cycles at $\Delta K=30$ MPa$\sqrt{m}$.

51. An aluminum alloy rolled plate product according to claim 50, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

52. An aluminum alloy rolled plate product according to claim 50, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

53. A lower wing skin structural member made in an aluminum alloy rolled plate product according to claim 50.

54. A method for obtaining an aluminum alloy rolled product according to claim 50, wherein said rolled product comprises a plate, said method comprising:

Casting a rolling ingot, followed by optional stress relieving, and scalping,
Homogenizing at a temperature between 450 and 510° C.,
Hot-rolling on a reversing mill, preferably with an exit temperature between 350 and 390° C.,
Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

55. An aluminum alloy rolled plate product according to claim 1, exhibiting in a corrosion test according to ASTM G 110, a maximum intergranular attack of less than 80 μm in T39 temper, and/or less than 200 μm in T851 temper, and/or less than 250 μm in T89 temper, and/or less than 300 μm in T351 temper.

56. An aluminum alloy rolled plate product according to claim 55, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

57. A lower wing skin structural member made in an aluminum alloy rolled plate product according to claim 55.

58. A method for obtaining an aluminum alloy rolled product according to claim 55, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

59. An aluminum alloy rolled plate product according to claim 1, exhibiting in a corrosion test according to ASTM G 110 a maximum intergranular attack of less than 70 μm in T39 temper, and/or less than 180 μm in T851 temper, and/or less than 220 μm in T89 temper, and/or less than 270 μm in T351 temper.

60. A lower wing skin structural member made in an aluminum alloy rolled plate product according to claim 59.

61. A method for obtaining an aluminum alloy rolled product according to claim 59, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

62. A lower wing skin structural member made in an aluminum alloy rolled plate product according to claim 1.

63. A method for obtaining an aluminum alloy rolled product according to claim 62, wherein said rolled product comprises a plate, said method comprising:

Casting a rolling ingot, followed by optional stress relieving, and scalping,

Homogenizing at a temperature between 450 and 510° C.,

Hot-rolling on a reversing mill, preferably with an exit temperature between 350 and 390° C., Optionally, for plate with a thickness of less than about 30 mm, conducting at least one intermediate reheating to about 480° C., followed by one or more hot-rolling passes, the final exit temperature optionally being between 350 and 370° C., Solution heat treating at a temperature between 490 and 510° C., followed by water quenching and natural aging, Cold working by stretching alone or cold rolling followed by stretching, optionally followed by artificial aging.

64. A method for obtaining an aluminum alloy rolled plate product according to claim 1, wherein said rolled plate product comprises a plate, said method comprising:

(a) Casting a rolling ingot, followed by optional stress relieving, and scalping, (b) Homogenizing at a temperature between 450 and 510° C., (c) Hot-rolling on a reversing mill, preferably with an exit temperature between 350 and 390° C., (d) Optionally, for plate with a thickness of less than about 30 mm, conducting at least one intermediate reheating to about 480° C., followed by one or more hot-rolling passes, the final exit temperature optionally being between 350 and 370° C., (e) Solution heat treating at a temperature between 490 and 510° C., followed by water quenching and natural aging, (f) Cold working by stretching alone or cold rolling followed by stretching, optionally followed by artificial aging.

* * * * *